US011840082B2

(12) United States Patent
Yoshimura

(10) Patent No.: US 11,840,082 B2
(45) Date of Patent: Dec. 12, 2023

(54) LIQUID EJECTION HEAD AND RECORDING DEVICE

(71) Applicant: KYOCERA CORPORATION, Kyoto (JP)

(72) Inventor: Kazuya Yoshimura, Kirishima (JP)

(73) Assignee: KYOCERA CORPORATION, Kyoto (JP)

( * ) Notice: Subject to any disclaimer, the term of this patent is extended or adjusted under 35 U.S.C. 154(b) by 138 days.

(21) Appl. No.: 17/434,412

(22) PCT Filed: Feb. 5, 2020

(86) PCT No.: PCT/JP2020/004317

§ 371 (c)(1),
(2) Date: Aug. 27, 2021

(87) PCT Pub. No.: WO2020/175059

PCT Pub. Date: Sep. 3, 2020

(65) Prior Publication Data

US 2022/0153025 A1 May 19, 2022

(30) Foreign Application Priority Data

Feb. 28, 2019 (JP) ..... 2019-035741

(51) Int. Cl.
*B41J 2/14* (2006.01)
*B41J 2/165* (2006.01)

(52) U.S. Cl.
CPC ..... *B41J 2/14209* (2013.01); *B41J 2/1433* (2013.01); *B41J 2/16538* (2013.01); *B41J 2/16505* (2013.01); *B41J 2002/14225* (2013.01)

(58) Field of Classification Search
CPC .. B41J 2/14209; B41J 2/1433; B41J 2/16538; B41J 2/16505; B41J 2002/14225
See application file for complete search history.

(56) References Cited

U.S. PATENT DOCUMENTS

| | | | | |
|---|---|---|---|---|
| 6,132,028 | A | 10/2000 | Su et al. | |
| 9,108,412 | B2 * | 8/2015 | Chino | B41J 2/16535 |
| 2004/0263584 | A1 | 12/2004 | Ito et al. | |

FOREIGN PATENT DOCUMENTS

| | | | | |
|---|---|---|---|---|
| JP | 6-190307 | * | 7/1994 | B41J 2/135 |
| JP | H6190307 | A | 7/1994 | |
| JP | 200259551 | A | 2/2002 | |
| JP | 2002370366 | A | 12/2002 | |
| JP | 200522181 | A | 1/2005 | |
| JP | 200836953 | A | 2/2008 | |
| JP | 2015202691 | A | 11/2015 | |

* cited by examiner

*Primary Examiner* — Geoffrey S Mruk
(74) *Attorney, Agent, or Firm* — HAUPTMAN HAM, LLP

(57) ABSTRACT

A channel member of a liquid ejection head includes an ejection surface, an outer peripheral surface that is connected to an outer edge of the ejection surface and that faces outside of the ejection surface in a direction along the ejection surface, and a plurality of ejection holes that open in the ejection surface. The channel member includes a plurality of concave portions in the outer edge of the ejection surface, the plurality of concave portions being recessed in the ejection surface and being recessed in the outer peripheral surface. With the configuration, it is possible to collect, in the concave portions, a liquid (such as ink mist) that has leaked out from the ejection holes.

20 Claims, 9 Drawing Sheets

LIQUID EJECTION HEAD AND RECORDING DEVICE

RELATED APPLICATIONS

The present application is a National Phase of International Application No. PCT/JP2020/004317, filed Feb. 5, 2020, and claims priority based on Japanese Patent Application No. 2019-035741, filed Feb. 28, 2019.

TECHNICAL FIELD

The present disclosure relates to a liquid ejection head and a recording device.

BACKGROUND ART

Liquid ejection heads that eject a liquid (for example, an ink) toward a recording medium (for example, paper) are known (see, for example, PTLs 1 and 2). Such a liquid ejection head includes a channel member through which the liquid flows. The channel member includes an ejection surface that faces a recording medium and a plurality of ejection holes that open in the ejection surface. The liquid ejection head performs printing by ejecting liquid droplets from the plurality of ejection holes.

CITATION LIST

Patent Literature

PTL 1: Japanese Unexamined Patent Application Publication No. 2002-370366

PTL 2: Japanese Unexamined Patent Application Publication No. 2002-59551

SUMMARY OF INVENTION

A liquid ejection head according to an aspect of the present disclosure includes a channel member including an ejection surface, an outer peripheral surface that is connected to an outer edge of the ejection surface and that faces outside of the ejection surface in a direction along the ejection surface, and a plurality of ejection holes that open in the ejection surface. The channel member includes a plurality of concave portions in the outer edge of the ejection surface, the plurality of concave portions being recessed in the ejection surface and being recessed in the outer peripheral surface.

A recording device according to an aspect of the present disclosure includes the liquid ejection head and a movement unit that moves the liquid ejection head and a recording medium relative to each other.

DESCRIPTION OF EMBODIMENTS

Hereafter, embodiments of the present disclosure will be described with reference to the drawings. Figures used in the following description are schematic; and dimensions, proportions, and the like in the figures do not necessarily coincide with actual ones. Even in figures that illustrate the same members, the dimensions, the proportions, and the like may not coincide with each other, for the purpose of exaggerating the shapes and the like.

First Embodiment (Overall Structure of Printer)

Figure 1A:
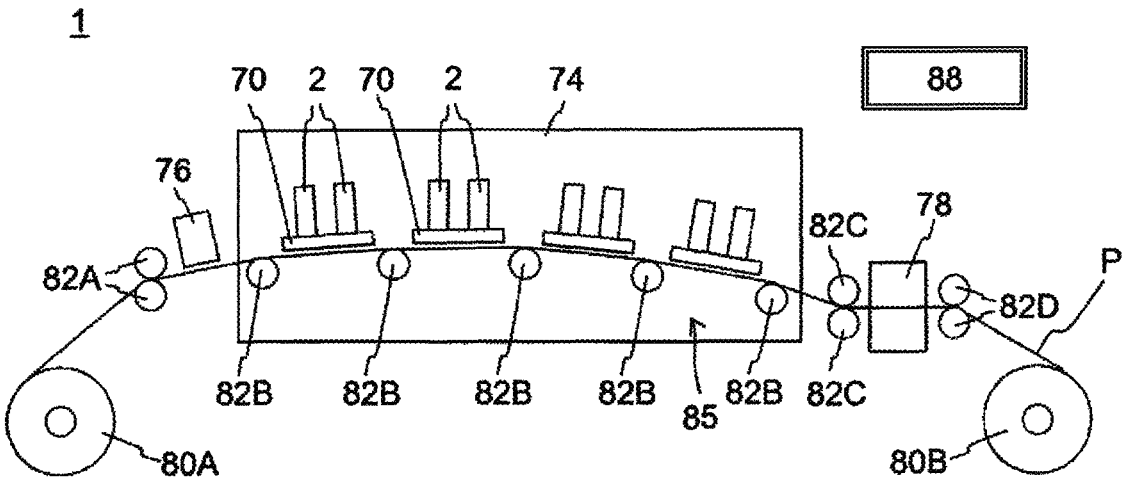
FIG. 1A is a side view and FIG. 1B is a plan view of a recording device including liquid ejection heads each according to a first embodiment of the present disclosure.
Figure 1B:
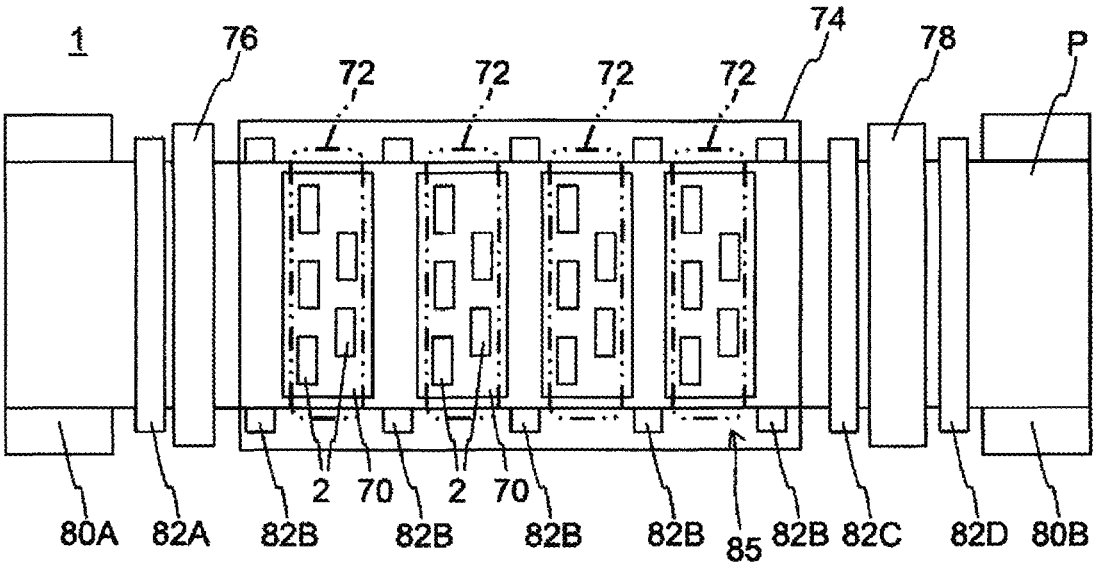

FIG. 1A is a schematic side view of a color inkjet printer 1 (an example of a recording device, which may be simply referred to as a "printer" in the following description) including liquid ejection heads 2 each according to a first embodiment of the present disclosure (each of which may be simply referred to as a "head" in the following description). FIG. 1B is a schematic plan view of the printer 1.

Regarding the head 2 or the printer 1, any direction may be defined as the vertical direction. For convenience, a direction perpendicular to the plane of FIG. 1A is defined as the vertical direction, and terms such as "upper surface", "lower surface", and the like may be used. Unless otherwise noted, the term "plan view" or the like refers to a view seen in the direction perpendicular to the plane of FIG. 1A.

The printer 1 moves print paper P (an example of a recording medium) relative to the heads 2 by transporting the print paper P from a feed roller 80A to a take-up roller 80B. The feed roller 80A, the take-up roller 80B, and various rollers described below constitute a movement unit 85 that moves the print paper P and the heads 2 relative to each other. A controller 88 controls the heads 2 based on print data that is data of images, characters, and the like, to cause a liquid to be ejected toward the print paper P and to cause liquid droplets to land on the print paper P, thereby performing recording, such as printing, on the print paper P.

In the present embodiment, the heads 2 are fixed to the printer 1, and the printer 1 is a so-called line printer. As another embodiment, the recording device may be a so-called serial printer that alternately performs an operation of ejecting liquid droplets while moving a head 2 in a direction that intersects the transport direction of the print paper P (for example, a direction substantially perpendicular to the transport direction) and an operation of transporting the print paper P.

In the printer 1, four flat-plate-shaped head-mounting frames 70 (hereafter, each of which may be simply referred to as a "frame") are fixed to be substantially parallel to the print paper P. Five holes (not shown) are formed in each frame 70, and five heads 2 are mounted on parts of the frame 70 where the respective holes are formed. The five heads 2 mounted on one frame 70 constitute one head group 72. The printer 1 includes four head groups 72, and, in total, twenty heads 2 are mounted.

Liquid ejection parts of the heads 2 mounted on the frame 70 face the print paper P. The distance between the heads 2 and the print paper P is, for example, about 0.5 to 20 mm.

The twenty heads 2 may be connected to the controller 88 directly, or may be connected to the controller 88 via a distributor that distributes print data. For example, the controller 88 may send print data to one distributor, and the distributor may distribute the print data to the twenty heads 2. Alternatively, for example, the controller 88 may distribute print data to four distributors corresponding to the four head groups 72, and each distributor may distribute print data to the five heads 2 in the corresponding head group 72.

The head 2 has a shape that is elongated in a direction from the front side toward the back side of FIG. 1A, which is the up-down direction in FIG. 1B. In each head group 72, three heads 2 are arranged in a direction that intersects (for example, that is substantially perpendicular to) the transport direction of the print paper P, and the other two heads 2 are arranged at positions that are displaced in the transport direction and that are respectively between the three heads 2. In other words, in each head group 72, the heads 2 are arranged in a staggered pattern. The head 2 are arranged so that areas over which the heads 2 can perform printing are connected in the width direction of the print paper P, that is, in a direction that intersects the transport direction of the print paper P or so that ends of the areas overlap. Thus, it is possible to perform printing without a gap in the width direction of the print paper P.

The four head groups 72 are arranged in the transport direction of the print paper P. A liquid (for example, an ink) is supplied to each head 2 from a liquid supply tank (not shown). Inks of the same color are supplied to heads 2 belonging to one head group 72, and the four head groups 72 can perform printing by using inks of four colors. The colors of inks ejected from the head groups 72 are, for example, magenta (M), yellow (Y), cyan (C), and black (K). A color image can be printed by ejecting the inks to land on the print paper P.

The number of heads 2 mounted in the printer 1 may be one, if the printer 1 is to perform monochrome printing over an area that can be printed with one head 2. The number of heads 2 included in each head group 72 and the number of head groups 72 may be changed as appropriate in accordance with an image to be printed and printing conditions. For example, the number of head groups 72 may be increased in order to perform printing with a larger number of colors. Even when heads 2 having the same performance are used, the transport speed can be increased by disposing a plurality of head groups 72 that perform printing with the same color and by performing printing alternately in the transport direction. Thus, it is possible to increase the print area per unit time. Resolution in the width direction of the print paper P may be increased by preparing a plurality of head groups 72 that perform printing with the same color and by arranging the head groups 72 so as to be displaced in a direction that intersects the transport direction.

Moreover, in addition to performing printing by using color inks, in order to perform surface-treatment of the print paper P, a head 2 may perform printing by using a liquid such as a coating agent uniformly or with patterning. As the coating agent, for example, when a recording medium into which a liquid does not easily permeate is used, a coating agent that forms a liquid-receiving layer may be used so that the liquid can be easily fixed. As another example of the coating agent, when a recording medium into which a liquid easily permeates is used, a coating agent that forms a liquid-permeation suppressing layer may be used so that bleeding of the liquid will not become too large and so that the liquid will not be mixed with another liquid that has landed at an adjacent position. Instead of being printed by the head 2, the coating agent may be uniformly applied by a coater 76 that is controlled by the controller 88.

The printer 1 performs printing on the print paper P, which is a recording medium. The print paper P is wound around the feed roller 80A, and the print paper P fed from the feed roller 80A passes below the heads 2 mounted on the frames 70, then passes between two transport rollers 82C, and is finally taken up by the take-up roller 80B. During printing, the transport roller 82C is rotated so that the print paper P is transported at a constant speed, and the heads 2 perform printing on the print paper P.

Next, details of the printer 1 will be described in the order in which the print paper P is transported. The print paper P fed from the feed roller 80A passes between the two guide rollers 82A and then passes below the coater 76. The coater 76 applies the aforementioned coating agent to the print paper P.

Next, the print paper P enters a head chamber 74 that contains the frames 70 on which the heads 2 are mounted. The head chamber 74 is a space that is substantially isolated from the outside, except that parts of the head chamber 74, such as an inlet and an outlet for the print paper P, are connected to the outside. As necessary, the control factors of the head chamber 74, such as temperature, humidity, and air pressure are controlled by the controller 88 and the like. Because the effect of disturbance in the head chamber 74 can be made small compared with the outside where the printer 1 is set, the range of variation of the control factors can be made narrower than that of the outside.

Five guide rollers 82B are disposed in the head chamber 74, and the print paper P is transported over the guide rollers 82B. In a side view, the five guide rollers 82B are arranged in such a way that the center is convex in the direction in which the frames 70 are arranged. Thus, the print paper P, which is transported over the five guide rollers 82B, has an arc shape in the side view, and a tension is applied to each part of the print paper P between a corresponding pair of the guide rollers 82B so that the part becomes flat. One frame 70 is disposed between each pair of the guide rollers 82B. The frames 70 are set at slightly different angles so that the frames 70 are parallel to the print paper P transported below the frames 70.

The print paper P that has exited the head chamber 74 passes between the two transport rollers 82C, passes through the inside of a drier 78, passes between two guide rollers 82D, and is taken up by the take-up roller 80B. The transport speed of the print paper P is, for example, 100 m/min. Each roller may be controlled by the controller 88 or may be manually operated by a human operator.

Because the print paper P is dried by the drier 78, on the take-up roller 80B, sticking of parts of the print paper P that is wound in an overlapping manner and smearing with wet liquid are not likely to occur. It is necessary to perform drying rapidly in order to perform high-speed printing. In order to accelerate drying, the drier 78 may perform drying by sequentially using a plurality of drying methods or may perform drying by simultaneously using a plurality of drying methods. Examples of a drying method that is used in such a case include blowing of warm air, irradiation with infrared radiation, and contact with a heated roller. When performing irradiation with infrared radiation, infrared radiation in a specific frequency range may be emitted so that drying can be accelerated while reducing damage to the print paper P. When bringing the print paper P into contact with a heated roller, the heat transfer time may be increased by transporting the print paper P along the cylindrical surface of the roller. The range over which the print paper P is transported along the cylindrical surface of the roller is preferably greater than or equal to ¼ turn of the cylindrical surface of the roller, and more preferably, greater than or equal to ½ turn of the cylindrical surface of the roller. When performing printing with a UV-curable ink or the like, a UV irradiation light source may be disposed, instead of or in addition to the drier 78. The UV irradiation light source may be disposed between the frames 70.

The printer 1 may include a cleaning unit that cleans the head 2. The cleaning unit performs cleaning by, for example, wiping and/or capping. Wiping is a method in which, for example, a flexible wiper is used to scrub a surface of a portion from which a liquid is ejected, such as an ejection surface 5*a* (described below), to remove a liquid adhering to the surface. Capping is a cleaning method that is performed, for example, as follows. First, a cap is placed so as to cover (called "capping") a portion from which a liquid is ejected, such as the ejection surface 5*a*, to form a substantially closed space between the ejection surface 5*a* and the cap. Ejection of a liquid is repeatedly performed in such a state to remove a liquid whose viscosity has become higher than that in a normal state, foreign substances, and the like that have been clogging an ejection hole 9 (described below). Due to capping, a liquid that is being used for cleaning is unlikely to be scattered to the printer 1, and the liquid is unlikely to adhere to the print paper P and a transport mechanism such as a roller. The ejection surface 5*a* that has been cleaned may be further wiped. Cleaning by wiping and/or capping may be performed by a human operator by manually operating a wiper and/or a cap attached to the printer 1 or may be automatically performed by the controller 88.

The recording medium may be a rolled cloth or the like, instead of the print paper P. The printer 1 may transport a transport belt to transport a recording medium placed on the transport belt, instead of directly transporting the print paper P. By doing so, a cut sheet, a cut cloth, wood, or a tile can be used as the recording medium. Moreover, a wiring pattern of an electronic device may be printed by ejecting a liquid including conductive particles from the head 2. Furthermore, a chemical may be produced by, for example, ejecting a predetermined amount of chemical agent or a liquid including a chemical agent from the head 2 toward a reaction vessel or the like and by causing a reaction or the like.

A position sensor, a velocity sensor, and/or a temperature sensor may be attached to the printer 1; and the controller 88 may control various parts of the printer 1 in accordance with the states of the parts of the printer 1 that can be detected from information items from these sensors. For example, if the temperature of the head 2, the temperature of a liquid in a liquid supply tank that supplies the liquid to the head 2, and/or the pressure that the liquid in the liquid supply tank applies to the head 2 is exerting an effect on the ejection characteristics (for example, the ejection amount and/or the ejection speed) of an ejected liquid, a drive signal for ejecting the liquid may be changed in accordance with these information items.

(Summary of Ejection Surface)

Figure 2:
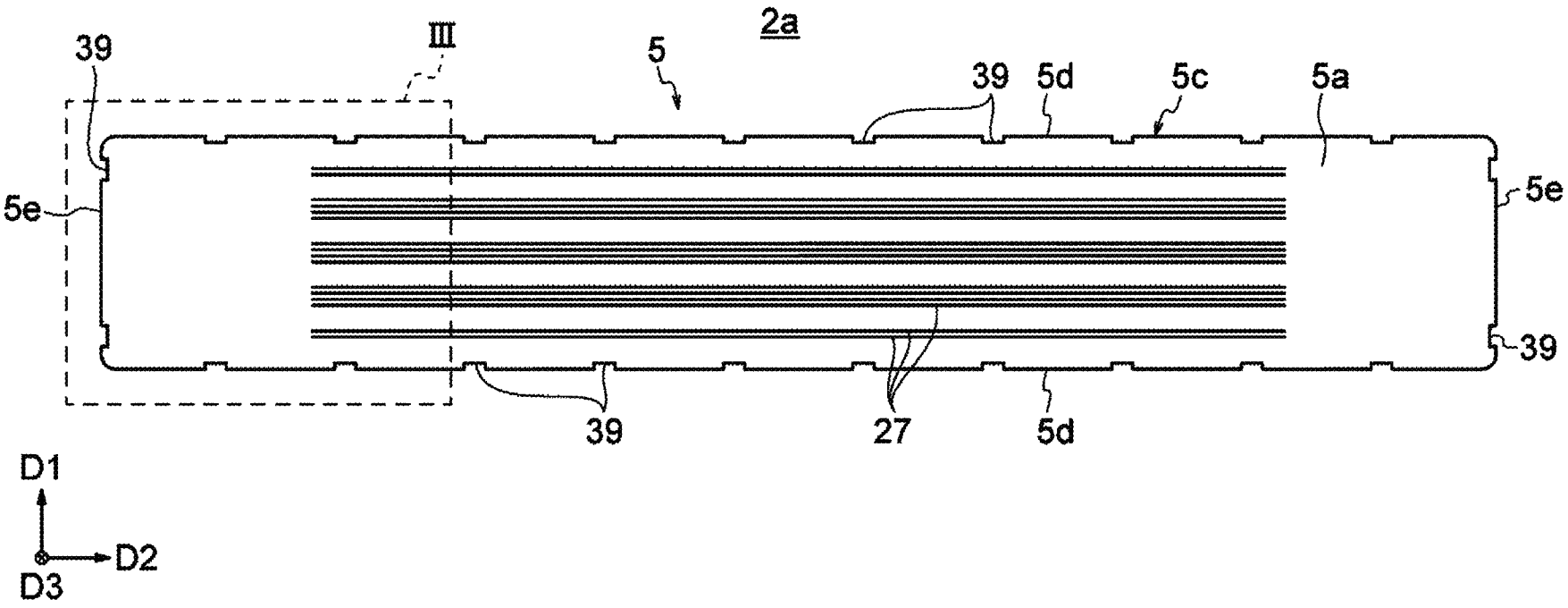
FIG. 2 is a plan view of an ejection surface, which ejects liquid droplets, of one of the liquid ejection heads shown in FIGS. 1A and 1B.
Figure 3:
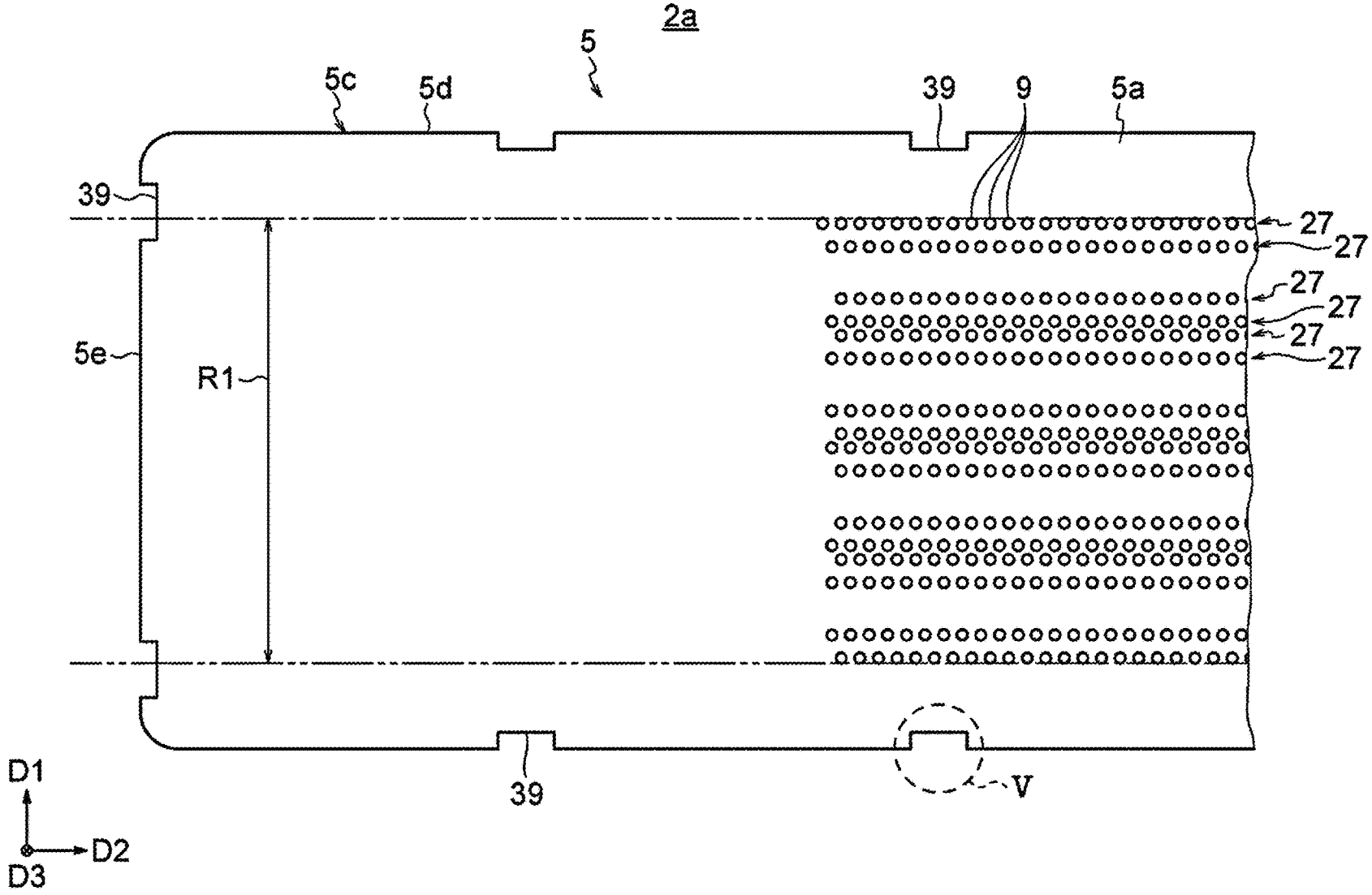
FIG. 3 is an enlarged view of a region III of FIG. 2.

FIG. 2 is a plan view illustrating a surface (the ejection surface 5*a*) of the head 2 (head body 2*a*) that faces the print paper P. FIG. 3 is an enlarged view of a region III of FIG. 2. In these figures, for convenience, a Cartesian coordinate system having a D1 axis, a D2 axis, and a D3 axis is attached. The D1 axis is defined to extend in the direction in which the head 2 and the print paper P move relative to each other. In the description of the present embodiment, the relationship between positive/negative of the D1 axis and the direction in which the print paper P is transported relative to the head 2 is not particularly limited. The D2 axis is defined to be parallel to the ejection surface 5*a* and the print paper P and to be perpendicular to the D1 axis. Positive/negative of the D2 axis is not particularly limited. The D3 axis is defined to be perpendicular to the ejection surface 5*a* and the print paper P. The −D3 side (the front side of the plane of FIGS. 2 and 3), which is the negative side of the D3 axis, is a direction from the head 2 toward the print paper P.

The ejection surface 5*a* is, for example, a flat surface that constitutes most of the surface of the head 2 facing the print paper P. As already described, the head 2 has a shape that is elongated in a direction (D2 direction) that intersects the direction in which the head 2 moves relative to the print paper P, and the ejection surface 5*a* also has a shape whose longitudinal direction is the D2 direction. To be specific, the ejection surface 5*a* has, for example, a substantially rectangular shape whose longitudinal direction is the D2 direction. Accordingly, an outer edge 5*c* of the ejection surface 5*a* includes a pair of long edges 5*d* (long sides) that face each other and a pair of short edges 5*e* (short sides) that connect end portions of the pair of long edges 5*d*.

A plurality of ejection holes 9 (FIG. 3) that eject ink droplets are formed in the ejection surface 5*a*. The plurality of ejection holes 9 are arranged in such a way that the positions thereof differ from each other in a direction (D2 direction) perpendicular to a direction (D1 direction) in which the head 2 and the print paper P move relative to each other. Accordingly, any two-dimensional image can be formed by ejecting ink droplets from the plurality of ejection holes 9 while moving the head 2 and the print paper P relative to each other by using the movement unit 85.

To be more specific, the plurality of ejection holes 9 are arranged along a plurality of lines (sixteen lines in the illustrated example). That is, the plurality of ejection holes 9 constitute a plurality of ejection-hole lines 27. In FIG. 2, the ejection-hole lines 27 are schematically shown by straight lines, because the ejection holes 9 are very small relative to the ejection surface 5*a*. The plurality of ejection-hole lines 27 differ from each other in the positions of the plurality of ejection holes 9 in the D2 direction. Thus, it is possible to form, on the print paper P, a plurality of dots that are arranged in the D2 direction at a pitch smaller than the pitch of the ejection holes 9 in each ejection-hole line 27.

The plurality of ejection-hole lines 27 are, for example, substantially parallel to each other and have lengths that are equivalent to each other. In the illustrated example, the ejection-hole lines 27 extend in a direction (D2 direction) perpendicular to the direction in which the head 2 and the print paper P move relative to each other. However, the ejection-hole lines 27 may be inclined with respect to the D2 direction. In the illustrated example, the size of the gaps between the plurality of ejection-hole lines 27 is not uniform. This is due to, for example, the convenience of arrangement of channels in the head 2. Needless to say, the size of the gaps between the ejection-hole lines 27 may be uniform.

(Head Body)

Figure 4:
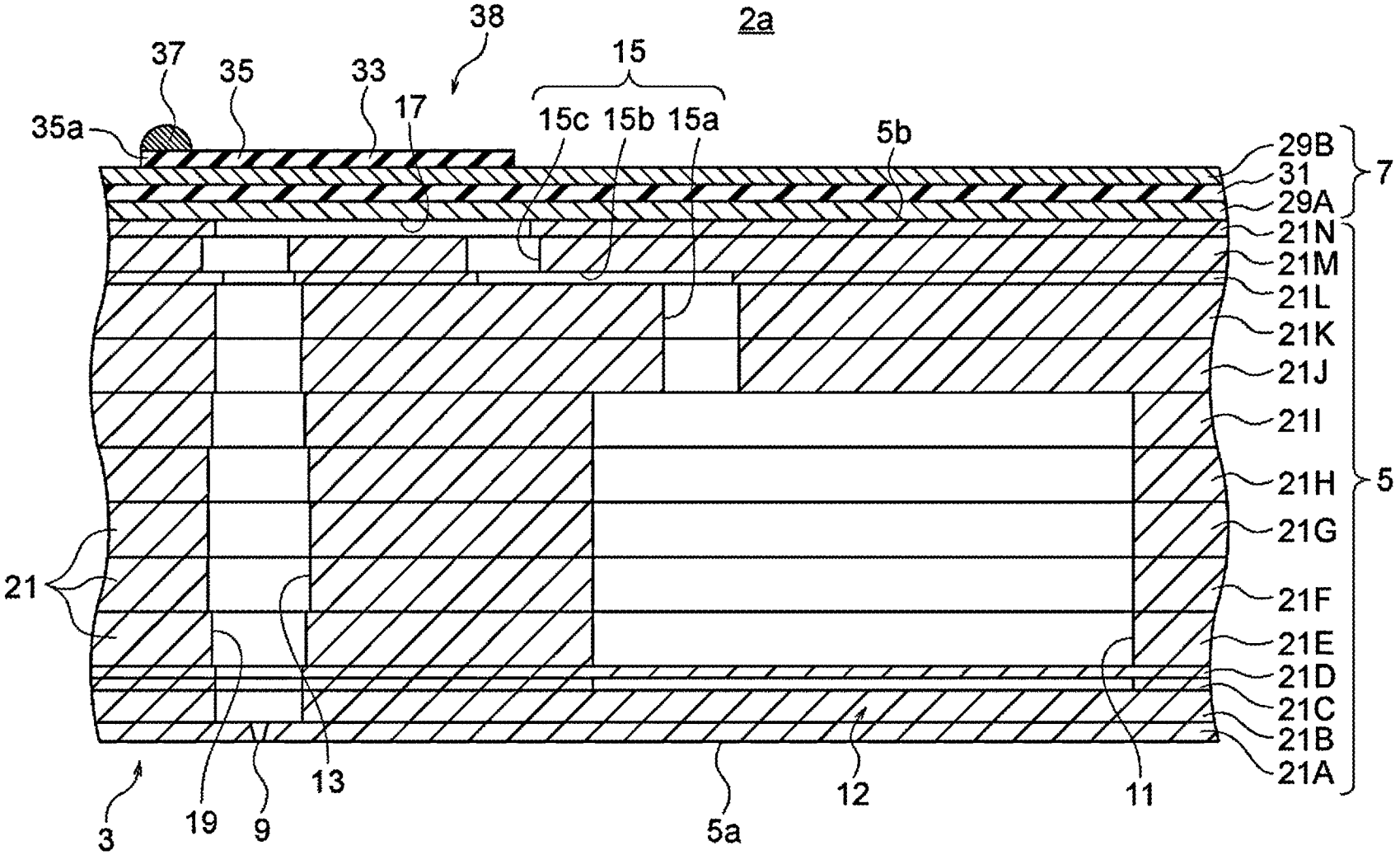
FIG. 4 is a schematic partial longitudinal sectional view of one of the liquid ejection heads shown in FIGS. 1A and 1B.

FIG. 4 is an enlarged sectional view of a part of a head body 2*a* included in the head 2. The lower side of FIG. 4 is the print paper P side. Here, mainly, a configuration related to one ejection hole 9 is illustrated.

The head body 2*a* is a substantially plate-shaped member, and one of the front and back surfaces of the plate-shape is the ejection surface 5*a* described above. The thickness of the head body 2*a* is, for example, greater than or equal to 0.5 mm and less than or equal to 2 mm. The head body 2*a* is a piezoelectric head that ejects liquid droplets by applying a pressure to a liquid by using mechanical strain of a piezoelectric element. The head body 2*a* includes a plurality of ejection elements 3 each of which including the ejection hole 9. The plurality of ejection elements 3 are arranged two-dimensionally along the ejection surface 5*a*.

From a different viewpoint, the head body 2*a* includes a substantially plate-shaped channel member 5 in which channels through which a liquid (ink) flows are formed, and an actuator substrate 7 for applying a pressure to the liquid in the channel member 5. The plurality of ejection elements 3 are constituted by the channel member 5 and the actuator substrate 7. The ejection surface 5*a* is constituted by the channel member 5. A surface of the channel member 5 opposite to the ejection surface 5*a* will be referred to as a "pressurization surface 5*b*".

The channel member 5 includes a common channel 11 and a plurality of individual channels 13 each of which is connected to the common channel 11 (one of the individual channels 13 is illustrated in FIG. 4). Each individual channel 13 includes the ejection hole 9 described above; and includes a connection channel 15, a pressurization chamber 17, and a partial channel 19, sequentially from the common channel 11 to the ejection hole 9.

The plurality of individual channels 13 and the common channel 11 are filled with a liquid. When the volume of the plurality of pressurization chambers 17 changes and a pressure is applied to the liquid, the liquid is fed from the plurality of pressurization chambers 17 to the plurality of partial channels 19, and a plurality of liquid droplets are ejected from the plurality of ejection holes 9. The liquid is supplied from the common channel 11 to the plurality of pressurization chambers 17 via the plurality of connection channels 15.

The channel member 5 is formed by, for example, stacking a plurality of plates 21A to 21N (the characters "A" to "N" may be omitted in the following description). In the plates 21, a plurality of holes (which are mainly through-holes but may be concave portions) that constitute the plurality of individual channels 13 and the common channel 11 are formed. The thicknesses and the number of the plurality of plates 21 may be set in any appropriate manner in accordance with the shapes and the like of the plurality of individual channels 13 and the common channel 11. The plurality of plates 21 may be made of any appropriate material. For example, the plurality of plates 21 are made of a metal or a resin. The thicknesses of the plates 21 are, for example, greater than or equal to 10 μm and less than or equal to 300 μm.

The plates 21 are fixed to each other by using, for example, an adhesive (not shown) interposed between the plates 21. In the description of the present embodiment, an expression disregarding the presence of the adhesive may be used.

(Shape of Channel)

The specific shape, the dimensions, and the like of each channel in the channel member 5 may be set in any appropriate manner. In the illustrated example, the shape and the dimensions are as follows.

The common channel 11 extends in the longitudinal direction of the head 2 (the direction perpendicular to the plane of FIG. 4). Although only one common channel 11 may be provided, for example, a plurality of common channels 11 are provided in parallel with each other. The cross-sectional shape of the common channel 11 is rectangular. Below the common channel 11, a damper 12 for attenuating pressure variation that has occurred in the common channel 11 is disposed. The damper 12 may be disposed above the common channel 11 instead of or in addition to below the common channel 11.

The plurality of individual channels 13 (from a different viewpoint, the ejection elements 3) are arranged in the length direction of each common channel 11. Accordingly, the plurality of ejection holes 9, which are individually included in the plurality of individual channels 13, are arranged along the common channel 11. In the arrangement of the ejection holes 9 illustrated in FIGS. 2 and 3, for example, two lines of ejection holes 9 may be arranged on each of two sides of the common channel 11. Thus, in total, sixteen lines of ejection holes 9 may be arranged in four common channels 11.

The pressurization chamber 17 has a thin shape that extends along the pressurization surface 5*b* with a uniform thickness. The thin shape is, for example, a shape whose thickness is smaller than any dimension in a plan view. The planar shape of the pressurization chamber 17 may be any appropriate shape such as a rhombus, a circle, an ellipse, or the like. The pressurization chamber 17 opens, for example, in the pressurization surface 5*b* and is closed by the actuator substrate 7. The pressurization chamber 17 may be closed by a plate 21. However, this may be considered as a matter of whether the plate 21 that closes the pressurization chamber 17 is regarded a part of the channel member 5 or as a part of the actuator substrate 7.

The partial channel 19 extends from the pressurization chamber 17 toward the ejection surface 5*a*. The shape of the partial channel 19 is a substantially right circular cylinder. The partial channel 19 may extend so as to be inclined from the pressurization chamber 17 toward the ejection surface 5*a*. In a plan view, the partial channel 19 is connected to, for example, an end portion of the pressurization chamber 17 in a predetermined direction (for example, the longitudinal direction of the pressurization chamber 17 in a plan view).

The ejection hole 9 opens in a part of a bottom surface (a surface opposite to the pressurization chamber 17) of the partial channel 19. The ejection hole 9 is positioned, for example, at substantially the center of the bottom surface of the partial channel 19. However, the ejection hole 9 may be displaced from the center of the bottom surface of the partial channel 19. The longitudinal sectional shape of the ejection hole 9 is a tapered shape whose diameter decreases toward the ejection surface 5*a*. However, the shape of a part or the entirety of the ejection hole 9 may be inversely-tapered.

The connection channel 15 includes, for example, a first part 15*a* that is connected to an upper surface of the common channel 11, a second part 15*b* that is connected to an upper surface of the first part 15*a* and extends in a planer direction, and a third part 15*c* that is connected to an upper surface of the second part 15*b* and connected to a lower surface of the pressurization chamber 17. The cross-sectional area of the second part 15*b* in a direction perpendicular to the flow direction is small compared with the cross-sectional area of the first part 15*a* and the third part 15*c* and compared with the cross-sectional area of the common channel 11 and the pressurization chamber 17. That is, the second part 15*b* serves as a so-called throttle.

In a plan view, the connection position where the connection channel 15 (the third part 15*c*) is connected to the pressurization chamber 17 is, for example, an end portion of the lower surface of the pressurization chamber 17 on a side opposite to the partial channel 19 with respect to the center of the lower surface. The connection position where the connection channel 15 (the first part 15*a*) is connected to the common channel 11 may be any position on the upper surface of the common channel 11 in the width direction.

(Actuator Substrate)

The actuator substrate 7 has a substantially plate-like shape having an area that extends over a plurality of pressurization chambers 17. The actuator substrate 7 is constituted by a so-called unimorph piezoelectric actuator. The actuator substrate 7 may be constituted by a piezoelectric actuator of another type, such as a bimorph piezoelectric actuator. The actuator substrate 7 includes, for example, a piezoelectric layer 29A, a common electrode 31, a piezoelectric layer 29B, and an individual electrode 33, sequentially from the channel member 5 side.

The piezoelectric layer 29A, the common electrode 31, and the piezoelectric layer 29B extend over a plurality of pressurization chambers 17 in a plan view. That is, these are provided common to the plurality of pressurization chambers 17. The individual electrode 33 is provided for each pressurization chamber 17 at a position facing the pressurization chamber 17. The planar shape and the dimensions of the individual electrode 33 are, for example, substantially the same as the planer shape and the dimensions of the pressurization chamber 17. However, the planar shape of the individual electrode 33 may be different from the planar shape of the pressurization chamber 17. The number of individual electrodes 33 is basically the same as the number of pressurization chambers 17. A part of the actuator substrate 7 corresponding to each pressurization chamber 17 will be referred to as a "pressurization element 38".

A part of the piezoelectric layer 29B interposed between the individual electrode 33 and the common electrode 31 is polarized in the thickness direction. Accordingly, for example, when an electric field (voltage) is applied by the individual electrode 33 and the common electrode 31 in the polarization direction of the piezoelectric layer 29B, the piezoelectric layer 29B contracts in a direction along the layer. The contraction is restrained by the piezoelectric layer 29A. As a result, the pressurization element 38 deforms to bend convexly toward the pressurization chamber 17 side. Accordingly, the volume of the pressurization chamber 17 is reduced, and a pressure is applied to the liquid in the pressurization chamber 17. When an electric field (voltage) is applied by the individual electrode 33 and the common electrode 31 in the opposite direction, the pressurization element 38 deforms to bend toward a side opposite to the pressurization chamber 17.

The thickness, the material, and the like of each of the layers that constitute the actuator substrate 7 may be set in any appropriate manner. For example, the thickness of each of the piezoelectric layers 29A and 29B may be greater than or equal to 10 μm and less than or equal to 40 μm. The thickness of the common electrode 31 may be greater than or equal to 1 μm and less than equal to 3 μm. The thickness of the individual electrode 33 may be greater than or equal to 0.5 μm and less than equal to 2 μm. The material or each of the piezoelectric layers 29A and 29B may be a ceramic material having ferroelectricity, such as a lead zirconate titanate (PZT) based material, a $NaNbO_3$ based material, a $BaTiO_3$ based material, a $(BiNa)NbO_3$ based material, a $BiNaNb_5O_{15}$ based material, or the like. The material of the piezoelectric layer 29A (vibration plate) may be a material that does not have piezoelectricity. The material of the common electrode 31 may be a metal material such as a Ag—Pd based material. The material of the individual electrode 33 may be a metal material such as a Au based material.

A lead-out electrode 35 extends from the individual electrode 33. An end portion (a land 35*a*) of the lead-out electrode 35 on a side opposite to the individual electrode 33 reaches outside of the pressurization chamber 17, and a connection electrode 37 is formed on the land 35*a*. The connection electrode 37 is joined to a signal-transmitting member (not shown) (for example FPC: Flexible printed circuits) included in the head 2. An electric potential (drive signal) is applied to the individual electrode 33 from the controller 88 via a signal-transmitting member, the connection electrode 37, and the lead-out electrode 35.

The lead-out electrode 35 is, for example, integrally formed with the individual electrode 33, and the material and the thickness of the lead-out electrode 35 are the same as those of the individual electrode 33. The connection electrode 37 is made of, for example, a conductive resin including conductive particles such as silver particles and has a thickness that is greater than or equal to 5 μm and less than or equal to 200 μm.

Although not illustrated, the common electrode 31 is, for example, connected to the aforementioned signal-transmitting member via a through-conductor that extends through the piezoelectric layer 29B at a position where the plurality of individual electrodes 33 are not disposed in a plan view. Accordingly, the common electrode 31 is connected to the controller 88. A reference electric potential is applied to the common electrode 31 via the signal-transmitting member.

(Other Configurations of Head)

Although not illustrated, the head 2 may include a housing, a driver IC, a wiring board, and the like, in addition to the head body 2*a*. The head body 2*a* may include other channel members that supply a liquid to the channel member 5. Such other channel members may support another member or may contribute to fixing of the head 2 to the frame 70.

(Number and Positions of Concave Portions Positioned in Outer Edge of Ejection Surface)

As illustrated in FIGS. 2 and 3, the channel member 5 includes a plurality of concave portions 39 in the outer edge 5*c* of the ejection surface 5*a*. In describing the concave portions 39, terms such as the ejection surface 5*a*, an outer peripheral surface 5*f* (described below), the outer edge 5*c*, the long edge 5*d*, and the short edge 5*e* may refer to, for convenience, parts of these members other than the concave portions 39. For example, an expression such as "the depth of the concave portion 39 from the ejection surface 5*a*" may be used.

The plurality of concave portions 39 may be provided in any one or more of the four edge portions (5*d*, 5*d*, 5*e*, and 5*e*) included in the outer edge 5*c*, and any one or more number of concave portions 39 may be provided in one edge portion. The positions, the pitch, and the like of the plurality of concave portions 39 in each edge portion may be set in any appropriate manner. In the example illustrated in the figures, these are as follows In the following description, unless otherwise noted, the positions and the pitch of the concave portions 39 may be regarded as those with reference to the centroid of each of the concave portions 39 in a plan view. Note that the centroid of a planar figure is a point where the first moment of area with respect to any axis passing through the point is zero.

The concave portions 39 are provided in all of the four edge portions (5*d*, 5*d*, 5*e*, and 5*e*) included in the outer edge 5*c*. A plurality of concave portions 39 are provided in each edge portion. To be more specific, ten concave portions 39 are provided in each long edge 5*d*, and two concave portions 39 are provided in each short edge 5*e*. In total, twenty-four concave portions 39 are provided.

The concave portions 39 of a pair of long edges 5*d* are provided at positions that are symmetric to each other for the pair of long edges 5*d* (at the same positions in the D2 direction). The plurality of concave portions 39 of each long edge 5*d* include, in the length direction of the long edge 5*d* (D2 direction), one or more (in the illustrated example, two or more) concave portions 39 in an area in which a plurality of ejection holes 9 are disposed and one or more (in the illustrated example, one in an area on each side) concave portions 39 also in an area in which no ejection hole 9 is disposed.

For all of the concave portions 39 of the long edge 5*d* or for a plurality of concave portions 39 in a predetermined area of the long edge 5*d* (for example, the area in which the ejection holes 9 are disposed), the plurality of pitches of the concave portion 39 are substantially equivalent. Here, the phrase "substantially equivalent" refers to a state in which the difference between each of the plurality of pitches and the average value of the pitches is less than or equal to 20% or 10% of the average value. From a different viewpoint, the concave portions 39 of the long edge 5*d* are disposed so as to divide the total length of the long edge 5*d* (the length between the pair of short edges 5*e*) substantially equally. The difference between the substantially-equally-divided length and the completely-equally-divided length of the long edge 5*d* is less than or equal to 20% or 10%.

The concave portions 39 of the pair of short edges 5*e* are provided at positions that are symmetric to each other for the pair of short edges 5*e* (the same positions in the D1 direction). In each short edge 5*e*, two concave portions 39 are provided at positions that are closer to two ends than to the center of the short edge 5*e*.

Here, a first region R1 (FIG. 3) that has a minimum width (length in the D1 direction) within which all of the ejection holes 9 are contained and that extends along the long edge 5*d* (extends in the D2 direction) is assumed. To be more specific, an edge portion of the first region R1 along the long edge 5*d* may coincide with an edge portion, on the long edge 5*d* side, of the ejection holes 9 that are closest to the long edge 5*d*. In this case, the centroids of the concave portions 39 of the short edge 5*e* are not positioned within the width of the first region R1. From a different viewpoint, in the short edge 5*e*, one or more (in the illustrated example, one) concave portions 39 positioned outside of the width of the first region R1 are provided on each of two sides of the first region R1 in the width direction (D1 direction). To be more specific, a part of the concave portion 39 closer than the centroid to the center the short edge 5*e* is positioned inside of the first region R1 in the width direction.

(Shape of Concave Portion)

Figure 5:
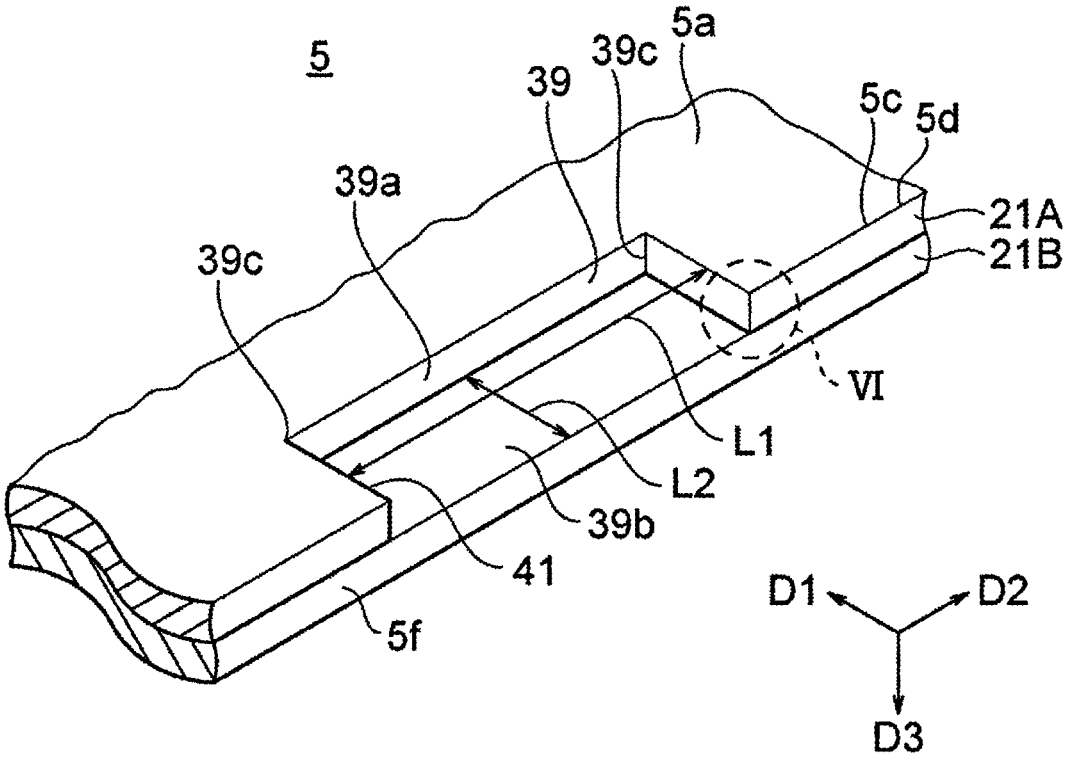
FIG. 5 is an enlarged perspective view of a region V of FIG. 3.

FIG. 5 is an enlarged perspective view of a region V of FIG. 3. Here, only one concave portion 39 provided in the long edge 5*d* is illustrated. The shape, the dimensions, and the like of other concave portions 39 of the long edge 5*d* and the concave portions 39 of the short edge 5*e* are the same as those of the concave portion 39 shown in the figure. However, the shape, the dimensions, and the like of some of the concave portions 39 may differ from each other.

In the following description, for convenience, a plate 21A having the ejection holes 9 may be referred to as a nozzle plate 21A. A plate 21B that overlaps the nozzle plate 21A on a side opposite to the ejection surface 5*a* may be referred to as a "cover plate 21B".

The concave portion 39 is recessed in the ejection surface 5*a* and is recessed also in the outer peripheral surface 5*f* of the channel member 5. That is, the concave portion 39 may be regarded as a concave portion for each of the ejection surface 5*a* and the outer peripheral surface 5*f*.

Note that the outer peripheral surface 5*f* is a surface that extends from the outer edge 5*c* of the ejection surface 5*a* to the back side of the ejection surface 5*a* (the pressurization surface 5*b* side), and faces outside of the ejection surface 5*a* in a direction along the ejection surface 5*a*. In the present embodiment, the outer peripheral surface 5*f* is composed of four side surfaces, which are a side surface facing in the +D1 direction, a side surface facing in the −D1 direction, a side surface facing in the +D2 direction, and a side surface facing in the −D2 direction. The outer peripheral surface 5*f* is, for example, substantially perpendicular to the ejection surface 5*a*. However, the outer peripheral surface 5*f* may be inclined with respect to the normal line of the ejection surface 5*a*. The outer peripheral surface 5*f* is basically constituted by the outer peripheral surfaces of the plurality of plates 21.

As described above, the concave portion 39, which is recessed in both of the ejection surface 5*a* and the outer peripheral surface 5*f*, is formed because the cover plate 21B overlaps a cutout 41 formed in an outer edge of the nozzle plate 21A. An inner surface of the concave portion 39 is constituted by a first surface 39*a* that has appeared because the cutout 41 of the nozzle plate 21A is formed, and a second surface 39*b* that is composed of a region (in a strict sense, an adhesive described below that covers the region) that is included in a surface of the cover plate 21B on the nozzle plate 21A side and that is exposed from the cutout 41.

The specific shape and the dimensions of the concave portion 39 may be set in any appropriate manner. The shape and the dimensions are, for example, as follows.

In the present embodiment, because the cutout 41 is provided in the nozzle plate 21A to form the concave portion 39, the concave portion 39 has a shape such that the depth from the ejection surface 5*a* is uniform. The depth is, if the effect of an adhesive described below and the like is neglected, equivalent to the thickness of the nozzle plate 21A, and is, for example, greater than or equal to 5 μm and less than or equal to 100 μm.

The first surface 39*a*, which has appeared due to the cutout 41, intersects the ejection surface 5*a* and is, for example, perpendicular to the ejection surface 5*a*. Accordingly, the shape and the size of the cross section of the concave portion 39 parallel to the ejection surface 5*a* are uniform in the depth direction from the ejection surface 5*a*. However, the first surface 39*a* may be inclined with respect to the ejection surface 5*a*. In such a case, some or all of the following descriptions about the shape and the dimensions of the concave portion 39 in a plan view of the ejection surface 5*a* may hold true at any position in the depth direction from the ejection surface 5*a* or may hold true at only a reference position (for example, the position of the ejection surface 5*a*).

In the illustrated example, the shape of the concave portion 39 in a plan view of the ejection surface 5*a* is rectangular. From a different viewpoint, the inner surface of the concave portion 39 (the first surface 39*a*) includes two concave corners 39*c* in a plan view of the ejection surface 5*a*. Here, the corners 39*c* are not chamfered. That is, two straight lines (three-dimensionally, two flat surfaces) intersect each other in a plan view of the ejection surface 5*a*. A rounded part or the like due to processing precision may be present. Even if one or both of the two straight lines is/are replaced with a curved line/curved lines, a part formed by the two lines may be regarded as a corner as long as a discontinuous point of change is present. In contrast to the illustrated example, the corners 39*c* may be chamfered.

In a plan view of the ejection surface 5*a*, the length L1 of the concave portion 39 in a direction along the outer edge 5*c* (the D2 direction for the long edge 5*d*, and the D1 direction for the short edge 5*e*) and the depth L1 of the concave portion 39 from the outer edge 5*c* are greater than, for example, the diameter (the maximum diameter) of the ejection hole 9. If the shape of the concave portion 39 in a plan view of the ejection surface 5*a* is not rectangular, the length L1 may be the maximum length in the direction along the outer edge 5*c* (the same applies hereafter). The depth L2 may be the maximum depth from the outer edge 5*c* (the same applies hereafter). In contrast to the description of the present embodiment, the length L1 and/or the depth L2 may be less than the diameter of the ejection hole 9.

To be more specific, for example, the length L1 may be greater than or equal to 10 times, 20 times, or 50 times the diameter of the ejection hole 9. The length may be less than or equal to 1000 times, 500 times, or 200 times the diameter of the ejection hole 9. These lower limits and upper limits may be combined in any appropriate manner. The length L1 may be greater than or equal to 1 time or 2 times the pitch (if the pitch is not uniform, the average pitch) of the ejection holes 9 in one ejection-hole line 27. The length L1 may be less than or equal to 20 times, 10 times, or 5 times the pitch of the ejection holes 9. These lower limits and upper limits may be combined in any appropriate manner. For example, the depth L2 may be greater than or equal to 2 times or 5 times the diameter of the ejection hole 9. The depth L2 may be less than or equal to 50 times or 20 times the diameter of the ejection hole. These lower limits and upper limits may be combined in any appropriate manner.

The length L1 may be, for example, greater than or equal to 0.5 mm or 1 mm. The length L1 may be less than or equal to 10 mm or 5 mm. These lower limits and upper limits may be combined in any appropriate manner. For example, the depth L2 may be greater than or equal to 0.05 mm or 0.1 mm. The depth L2 may be less than or equal to 1 mm or 0.5 mm. These lower limits and upper limits may be combined in any appropriate manner.

In a plan view of the ejection surface 5*a*, the length L1 is, for example, greater than the depth L2. For example, the length L1 may be greater than or equal to 2 times, 5 times, or 10 times the depth L2. Needless to say, in contrast to the illustrated example, the length L1 may be less than or equal to the depth L2.

(Concave Portion and Surfaces Therearound)

Figure 6:
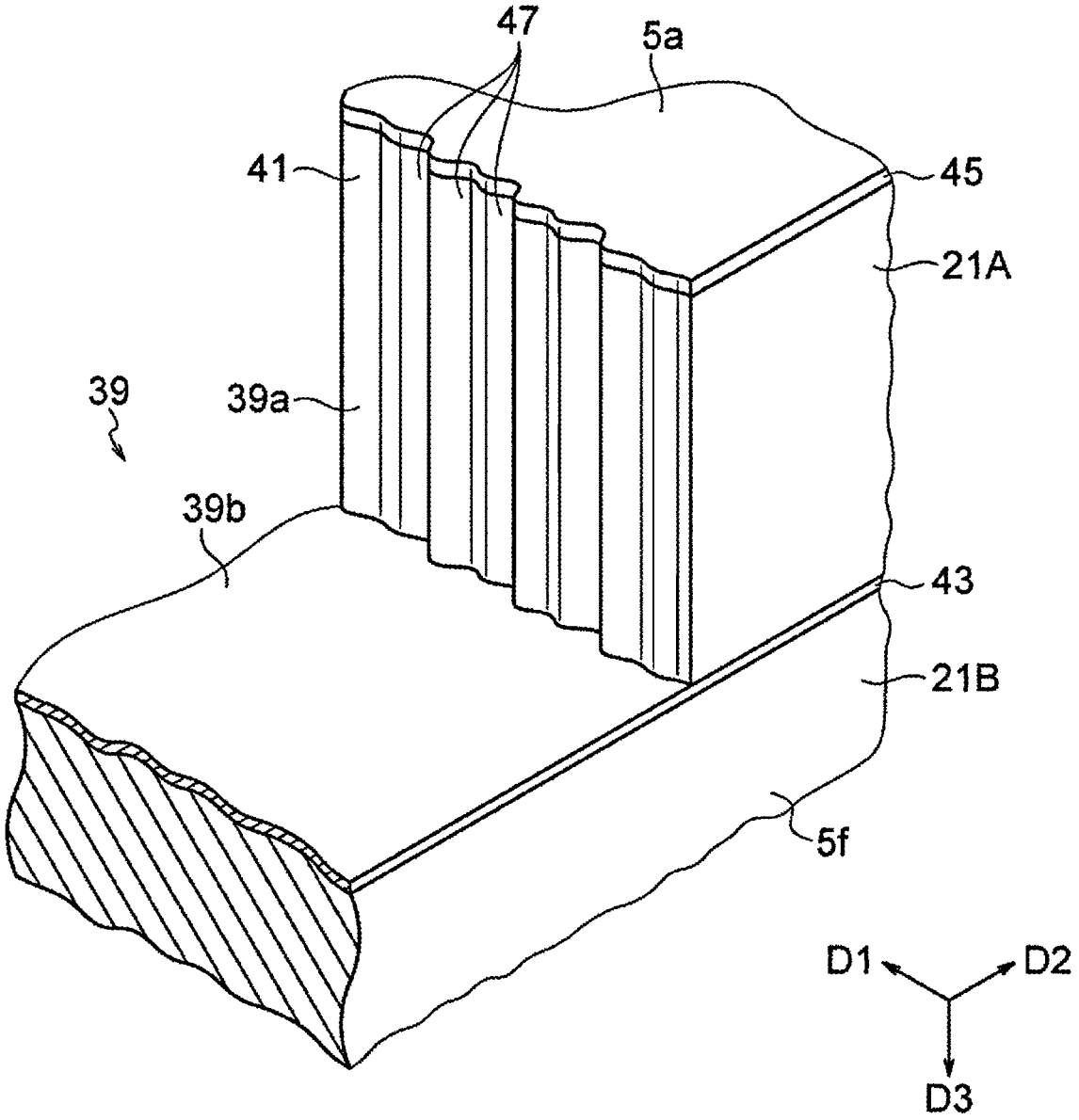
FIG. 6 is an enlarged view of a region VI of FIG. 5.

FIG. 6 is an enlarged view of a region VI in FIG. 5.

As illustrated in this figure, the channel member 5 is not constituted by only the plurality of plates 21, and includes, for example, an adhesive 43 that bonds the plurality of plates 21 to each other and a water-repellent film 45 provided on the ejection surface 5*a*. The surface of the channel member 5 has asperities in a microscopic view. As a result, for example, the properties of the inner surface of the concave portion 39 differ from those of surfaces therearound. To be specific, the properties are as follows.

(Adhesive)

As already described, the nozzle plate 21A and the cover plate 21B are fixed to each other by using the adhesive 43 interposed therebetween. The adhesive 43 may be, for example, an organic adhesive, an inorganic adhesive, a heat curing adhesive, or a cold curing adhesive. For example, the adhesive 43 may be a thermosetting resin such as epoxy resin.

The thickness of the adhesive 43 is small, compared with the thickness of the nozzle plate 21A and the cover plate 21B. For example, the thickness of the adhesive 43 is less than or equal to ½, ⅕, or 1/10 of that of the nozzle plate 21A and/or the cover plate 21B. The thickness of the adhesive 43 is, for example, greater than or equal to 1 μm and less than or equal to 30 μm.

The adhesive 43 covers, for example, a region that is included in a surface of the cover plate 21B on the nozzle plate 21A side and that is exposed from the cutout 41 of the nozzle plate 21A. Accordingly, in a strict sense, the second surface 39*b* of the concave portion 39 is constituted not by the cover plate 21B but by the adhesive 43. The adhesive 43 may be disposed so as not to cover a region that is included in the cover plate 21B and that is exposed from the cutout 41, and the second surface 39*b* may be constituted by the cover plate 21B.

Although it may depend on the specific materials and the like of the adhesive 43 and the plate 21, for example, the water-repellency of the adhesive 43 is higher than the water-repellency of the nozzle plate 21A and/or the cover plate 21B (and/or the plates 21 other than these). However, contrary to the above, the water-repellency of the plate 21 may be higher than the water-repellency of the adhesive 43.

Here, the term "water-repellency" refers to a relative water-repellency (the same applies hereafter). Accordingly, although the water-repellency of the adhesive 43 or the plate 21 are mentioned, the contact angle of a liquid (water) on the adhesive 43 or the plate 21 need not be greater than or equal to 90°. For example, the water-repellency of the adhesive 43 is higher than the water-repellency of the plate 21 as long as the contact angle of water on the adhesive 43 is relatively greater than the contact angle of water on the plate 21.

An example of the magnitude of the contact angle is that, for example, the plate 21 is made of a stainless steel and the contact angle is greater than or equal to 80° and less than 90°. The adhesive 43 is made of an epoxy resin, and the contact angle is greater than or equal to 90° and less than or equal to 100°.

As can be deduced from the above, the water-repellency of the second surface 39*b* of the concave portion 39 (the adhesive 43) is, for example, higher than the water-repellency of the outer peripheral surface 5*f* of the channel member 5 (a side surface of the plate 21). Needless to say, in contrast to the above, the water-repellency of the second surface 39*b* (in the present embodiment, a surface of the adhesive 43 or the cover plate 21B on the nozzle plate 21A side) may be equivalent to or lower than the water-repellency of the outer peripheral surface 5*f*.

(Water-Repellent Film)

A surface of the nozzle plate 21A on the ejection surface 5*a* side is covered by the water-repellent film 45. Accordingly, in a strict sense, the ejection surface 5*a* is constituted not by the nozzle plate 21A but by the water-repellent film 45. However, the water-repellent film 45 may be regarded as a part of the nozzle plate 21A. In the description of the present embodiment, it may be expressed that the ejection surface 5*a* is constituted by the nozzle plate 21A. In contrast to the illustrated example, the water-repellent film 45 may be omitted, and the ejection surface 5*a* may be constituted by a surface of the nozzle plate 21A.

The water-repellent film 45 has a higher water repellency than at least the nozzle plate 21A. The water-repellency of the water-repellent film 45 is higher than the water-repellency of the adhesive 43. For example, while the adhesive 43 is made of an epoxy resin and the contact angle of water on the adhesive 43 is greater than or equal to 90° and less than 100°, the water-repellent film 45 is made of a fluorocarbon-based resin and the contact angle of water on the water-repellent film 45 is greater than or equal to 100°. However, in contrast to the above, the contact angle of the water-repellent film 45 may be less than or equal to the contact angle of the adhesive 43.

The thickness of the water-repellent film 45 may be set in any appropriate manner. For example, the thickness of the water-repellent film 45 may be less than or equal to ⅕, 1/10, or 1/20 of the thickness of the nozzle plate 21A, and may be, for example, less than or equal to 5 μm or 1 μm.

(Surface Roughness of Inner Surface of Concave Portion)

The first surface 39*a* of the concave portion 39 includes, for example, a plurality of grooves 47 that extend in the thickness direction (D3 direction) of the nozzle plate 21A. Although FIG. 6 illustrates only one of the three flat surfaces included in the first surface 39*a*, the other two flat surfaces are similar to the illustrated surface. The plurality of grooves 47 extend, for example, substantially linearly from the ejection surface 5*a* to a surface of the nozzle plate 21A on the cover plate 21B side. The number, the depth, the width, the cross-sectional shape, and the like of the plurality of grooves 47 may be set in any appropriate manner. The depth, the width, the cross-sectional shape, and the like may vary among the plurality of grooves 47.

The depth and the width of the plurality of grooves 47 may be, for example, comparatively small or comparatively large. An example of a case where the depth and the width are comparatively small is a case where the depth and the width of all of the grooves 47 or most of the grooves 47 (for example, grooves 47 in 60% or greater or 80% or greater of the area of the first surface 39*a*) is less than 1 time or less than equal to ½ or 1/10 of the thickness of the nozzle plate 21A, and is less than or equal to 5 μm, 1 μm, or 0.1 μm. Because it is difficult to check the presence of a microscopic groove 47, a groove having a depth and/or a width greater than a certain level may be defined as the groove 47. For example, a groove having a depth and/or a with greater than or equal to 0.01 μm, 0.1 μm, or 1 μm may be defined as the groove 47.

The grooves 47 are not formed in a side surface of the nozzle plate 21A (a part of the outer peripheral surface 5*f*). Accordingly, from a different viewpoint, the surface roughness of the first surface 39*a* is greater than the surface roughness of the side surface of the nozzle plate 21A. The surface roughness may be, for example, the arithmetical mean roughness (Ra). It can be said that the side surface of the nozzle plate 21A is a region of the outer peripheral surface 5*f*, the region being on the ejection surface 5*a* side and between the plurality of concave portions 39. The surface roughness of not only the side surface of the nozzle plate 21A but also the side surface of another plate 21, such as the side surface of the cover plate 21B, may have a surface roughness less than that of the first surface 39*a* due to the reason that, for example, the grooves 47 are not formed.

(Method of Manufacturing Channel Member)

In a method for manufacturing the channel member 5, first, the plurality of plates 21 are prepared. The plurality of plates 21 are each prepared, for example, by punching and/or etching a metal plate. For example, to make the nozzle plate 21A by punching a metal plate, a die having a shape corresponding to the cutout 41 and the grooves 47 may be used.

Next, the adhesive 43 is applied with a predetermined thickness to one of the facing surfaces of two plates 21 that are to be bonded to each other. At this time, the adhesive 43 may be applied to the entire surface of the plate 21 or may be applied so as to avoid the positions of holes (such as holes to become channels) in the plate 21 to be bonded. The plurality of plates 21 are placed to overlap each other with the adhesive 43 therebetween and bonded to each other.

Here, in bonding the nozzle plate 21A and the cover plate 21B, for example, the adhesive 43 is applied to a surface of the cover plate 21B on the nozzle plate 21A side. At this time, because the adhesive 43 is applied also to a region that overlaps the cutout 41, the second surface 39*b* of the concave portion 39 is constituted by the adhesive 43.

(Modifications of Shape of Concave Portion)

Figure 7A:
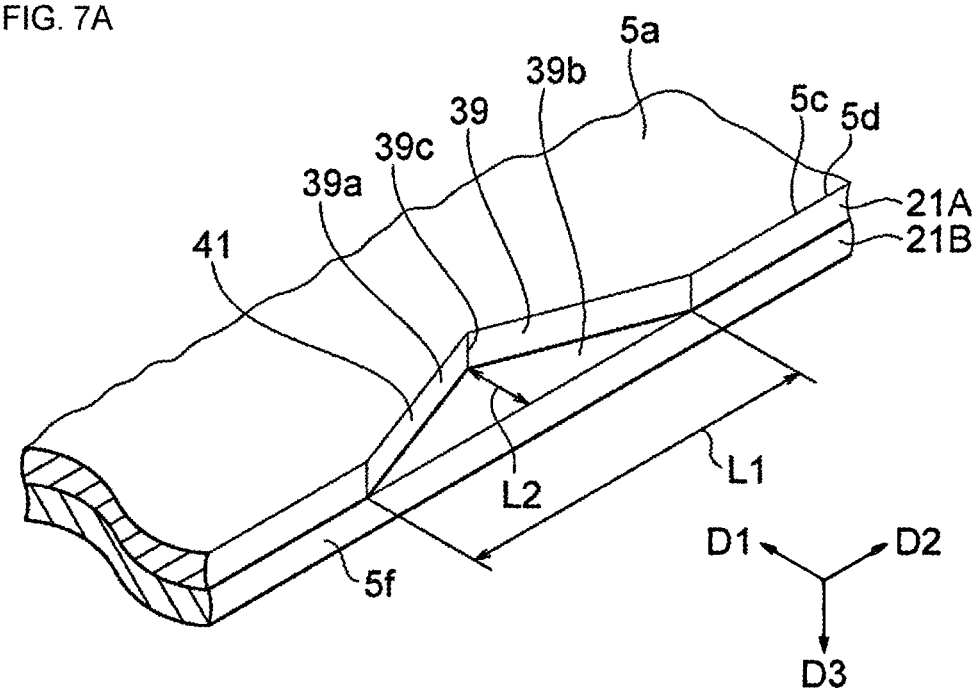
FIGS. 7A and 7B are perspective views each illustrating a modification of the shape of a concave portion of the ejection surface.
Figure 7B:
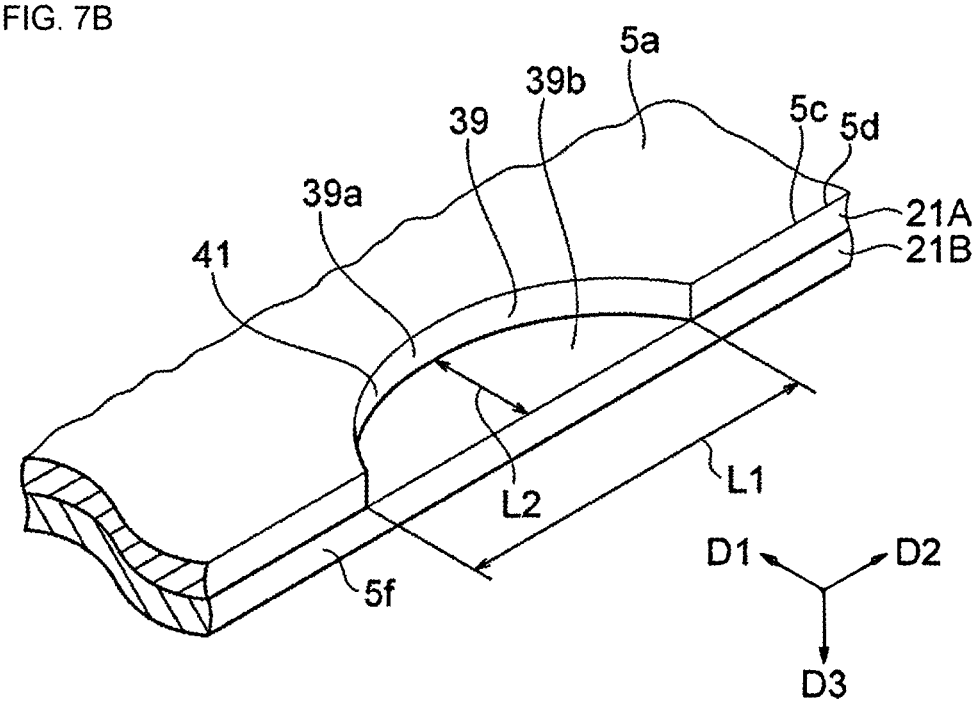

FIGS. 7A and 7*b* are views each corresponding to FIG. 5 and illustrating a modification of the shape of the concave portion 39.

In the modification illustrated in FIG. 7A, the shape of the concave portion 39 in a plan view of the ejection surface 5*a* is triangular. The triangle may be an isosceles triangle (the illustrated example), or the lengths of two sides of the first surface 39*a* may differ from each other. As with the rectangle in the embodiment, the triangle has a shape having a corner 39*c*. The corner 39*c* may be an obtuse corner or an acute corner.

In the modification illustrated in FIG. 7B, the shape of the concave portion 39 in a plan view of the ejection surface 5*a* is a shape whose inner surface is constituted by a concave curve (curved surface). To be more specific, for example, the curve has an arc shape, and the concave portion 39 has a shape such that a part of a circle is cut off along a straight line. The curvature of the arc may be set in any appropriate manner. In contrast to the illustrated example, the curvature of the curve may vary in accordance with the position of the curve (the curve need not have an arc shape).

Regarding matters that are not particularly mentioned, the concave portion 39 according to the modification may be similar to the concave portion 39 of the embodiment. For example, also regarding the length L1 and the depth L2, as in the embodiment, the length L1 may be set to be greater than the depth L2.

(Wiping Direction)

Figure 8A:
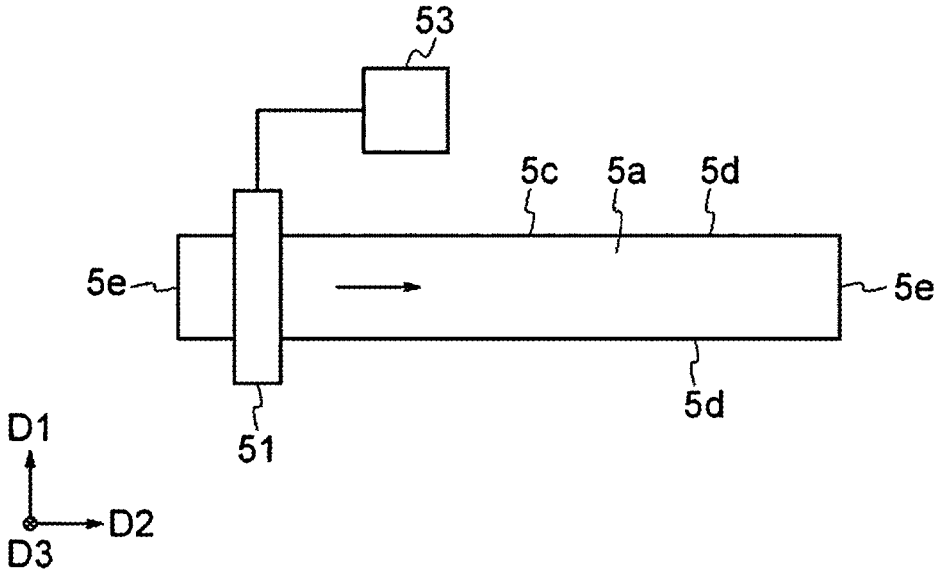
FIGS. 8A and 8B are schematic plan views each illustrating an example of a wiping direction.
Figure 8B:
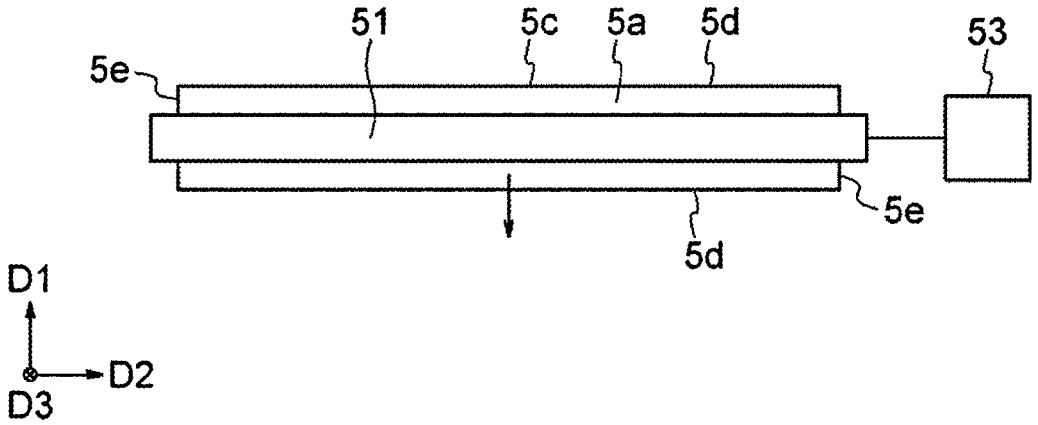

FIGS. 8A and 8B are schematic plan views illustrating examples of the wiping direction.

These figures schematically illustrate the ejection surface 5*a*, a wiper 51 that slides over the ejection surface 5*a*, and a drive unit 53 that drives the wiper 51.

The wiper 51 is made of, for example, an elastic material. Examples of the elastic material include a thermosetting elastomer (rubber in a broad sense) and a thermoplastic elastomer. Examples of the thermosetting elastomer include a vulcanized rubber (rubber in a narrow sense) and a thermosetting-resin based elastomer. The wiper 51 may have any appropriate shape, such as a plate-like shape (blade shape), and an edge side of the plate is slid over the ejection surface 5*a*.

Although not illustrated, the drive unit 53 includes a guide portion that guides the wiper 51 in the movement direction thereof, and a drive source (such as a motor) that applies a driving force to the wiper 51.

In the example illustrated in FIG. 8A, the wiper 51 slides over the ejection surface 5*a* in the longitudinal direction of (for example, parallel to) the ejection surface 5*a*. In the example illustrated in FIG. 8B, the wiper 51 slides over the ejection surface 5*a* in the transversal direction of (for example, parallel to) the ejection surface 5*a*. Wiping may be performed only when the wiper 51 moves toward one side (only one-way) in the longitudinal direction (or the transversal direction) or may be performed when the wiper 51 moves toward both of the one side and the other side.

As described above, in the present embodiment, the liquid ejection head 2 includes the channel member 5. The channel member 5 includes the ejection surface 5*a*, the outer peripheral surface 5*f* that is connected to the outer edge 5*c* of the ejection surface 5*a* and that faces outside of the ejection surface 5*a* in a direction along the ejection surface 5*a*, and the plurality of ejection holes 9 that open in the ejection surface 5*a*. The channel member 5 includes the plurality of concave portions 39 in the outer edge 5*c* of the ejection surface 5*a*, the plurality of concave portions 39 being recessed in the ejection surface 5*a* and being recessed in the outer peripheral surface 5*f*.

Accordingly, for example, it is possible to collect, in the concave portions 39, a liquid (such as ink mist) that has leaked from the ejection holes 9. To be more specific, for example, a liquid that has adhered to the ejection surface 5*a* and/or the outer peripheral surface 5*f* flows along the ejection surface 5*a* or the outer peripheral surface 5*f* due to an inertial force as the head 2 moves, and is trapped by the concave portions 39. For example, due to a capillary action that occurs as the concave portions 39 each functions as a capillary, the liquid is pulled into the concave portions 39. Here, because the concave portions 39 open in the ejection surface 5*a* in which the ejection holes 9 open, the concave portions 39 can directly contain the liquid that has leaked from the ejection holes 9. On the other hand, for example, because the concave portions 39 open in the outer peripheral surface 5*f*, the liquid contained in the concave portions 39 can be easily drained to the outside. For example, when sliding the wiper 51 over the ejection surface 5*a*, it is possible cause the wiper 51 to push out the liquid in the concave portions 39 toward the outer peripheral surface 5*f* side.

In the embodiment or in the modification illustrated in FIG. 7A, the inner surface of each of the plurality of concave portions 39 includes the concave corner 39*c* in a plan view of the ejection surface 5*a*.

In this case, for example, because the corners 39*c* each function as a V-shaped groove (capillary) that extends from the ejection surface 5*a* toward the cover plate 21B side, a liquid on the ejection surface 5*a* side can be easily pulled toward the cover plate 21B side. From a different viewpoint, the probability that a liquid trapped in the concave portion 39 unintentionally flows out of the concave portion 39 is reduced.

In the modification illustrated in FIG. 7B, the inner surface of each of the plurality of concave portions 39 is constituted by a concave curve in a plan view of the ejection surface 5*a*.

In this case, for example, because a corner is not present, wear of the wiper 51 due to the concave portion 39 can be easily reduced. Moreover, when the wiper 51 pushes out a liquid in the concave portion 39, because the liquid smoothly moves along the first surface 39*a* having a curved shape, the liquid collected in the concave portion 39 can be easily drained from the concave portion 39.

In the present embodiment, in a plan view of the ejection surface 5*a*, the length L1 of each of the plurality of concave portions 39 in a direction along the outer edge 5*c* of the ejection surface 5*a* is greater than the depth L2 of the concave portion 39 from the outer edge 5*c* of the ejection surface 5*a*.

In this case, for example, it is possible to collect the liquid in a wide area in a direction along the outer edge 5*c*. On the other hand, for example, when sliding the wiper 51 over the ejection surface 5*a*, ink can be easily drained from the concave portion 39 toward the outer peripheral surface 5*f* side. Moreover, in a case where the concave portion 39 is constituted by the cutout 41 of the nozzle plate 21A, it is possible to reduce the probability that the nozzle plate 21A is peeled off from the cover plate 21B. To be more specific, a part of the adhesive 43 positioned on the second surface 39*b* of the concave portion 39 adheres to a region of the first surface 39*a* of the concave portion 39 (the inner surface of the cutout 41) on the cover plate 21B side, and contributes to joining of the nozzle plate 21A and the cover plate 21B. The joining area has a comparatively large length at a position near the outer edge of the nozzle plate 21A, compared with a configuration such that the depth L2 is greater than the length L1 (this configuration may also be included in the technology according to the present disclosure). As a result, the probability that the nozzle plate 21A and the cover plate 21B are peeled off from the outer edge is reduced.

In the present embodiment, the surface roughness of an inner surface (the first surface 39*a*) of each of the plurality of concave portions, the inner surface intersecting the ejection surface 5*a*, is greater than the surface roughness of a region of the outer peripheral surface 5*f*, the region being on the ejection surface 5*a* side and between the plurality of concave portions 39.

In this case, for example, because the surface roughness of the first surface 39*a* is high, the water-repellency of the first surface 39*a* is low. Additionally, or alternatively, the asperities of the first surface 39*a* cause a capillary action. As a result, a liquid can be easily collected in the concave portion 39.

In the present embodiment, each of the plurality of concave portions 39 includes the plurality of grooves 47 in an inner surface (the first surface 39*a*) that intersects the ejection surface 5*a*, the grooves 47 extending from the ejection surface 5*a* side toward the back side of the ejection surface 5*a*.

In this case, for example, the plurality of grooves 47 each functions as a capillary, and a liquid on the ejection surface 5*a* side can be pulled toward the cover plate 21B side. That is, the liquid can be easily collected in the concave portion 39.

In the present embodiment, the channel member 5 includes the nozzle plate 21A and the cover plate 21B. The nozzle plate 21A includes the plurality of ejection holes 9. The cover plate 21B overlaps a side of the nozzle plate 21A opposite to the ejection surface 5*a*. The nozzle plate 21A includes the plurality of cutouts 41 in an outer edge thereof in a plan view. The plurality of concave portions 39 are formed because the cover plate 21B overlaps the plurality of cutouts 41 on a side opposite to the ejection surface 5*a*.

Accordingly, for example, the depth of the concave portions 39 from the ejection surface 5*a* can be made large, compared with a configuration in which concave portions 39 whose depth is less than the thickness of the nozzle plate 21A are formed (such a configuration may also be included in the technology according to the present disclosure). As a result, the amount of liquid that can be contained in the concave portions 39 increases.

In the present embodiment, the channel member 5 includes the adhesive 43 that is interposed between and bonded to the nozzle plate 21A and the cover plate 21B. The adhesive 43 covers a region of the cover plate 21B, the region being exposed from the plurality of cutouts 41.

In this case, for example, the water-repellency of the second surface 39*b* of the concave portion 39 can be improved. As a result, for example, while collecting a liquid from the ejection surface 5*a* side by using the first surface 39*a*, the probability that the liquid strongly adheres to the second surface 39*b* can be reduced, and the liquid can be easily drained toward the outer peripheral surface 5*f* side. As already described, because a part of the adhesive 43 positioned on the second surface 39*b* of the concave portion 39 adheres also to a region of the first surface 39*a* of the concave portion 39 (the inner surface of the cutout 41) on the cover plate 21B side, the joining strength is improved.

In the present embodiment, the channel member 5 includes the water-repellent film 45 that covers the ejection surface 5*a* side of the nozzle plate 21A and that has a higher water-repellency than the adhesive 43.

In this case, for example, a liquid does not easily adhere to and remain on the ejection surface 5*a*. Moreover, the liquid does not easily move from the concave portion 39 to the ejection surface 5*a*, and the liquid contained in the concave portions 39 can be easily drained toward the outer peripheral surface 5*f* side by using the wiper 51.

In the present embodiment, the outer edge 5*c* of the ejection surface 5*a* includes a pair of long edges 5*d* that face each other and a pair of short edges 5*e* that connect end portions of the pair of long edges 5*d* to each other. When the first region R1 that has a minimum width within which all of the ejection holes 9 are contained and that extends along the pair of long edges 5*d* is assumed in the ejection surface 5*a*, the plurality of concave portions 39 include, in each of the pair of short edges 5*e* and on each of two sides in the width direction of the first region R1, a concave portion 39 whose centroid is positioned outside of the width of the first region R1, and do not include a concave portion 39 whose centroid is positioned inside of the width of the first region R1.

In this case, for example, even if a liquid contained in the concave portion 39 of the short edge 5*e* overflows from the concave portion 39, the probability that the overflowed liquid reaches the ejection hole 9 is reduced. In particular, as in the example illustrated in FIG. 8A, even if the liquid overflows from the concave portion 39 of the short edge 5*e* when the wiper 51 slides from one of the short edges 5*e* toward the other short edge 5*e* and the overflowed liquid is carried by the wiper 51, the probability that the liquid reaches the ejection hole 9 is reduced.

The printer 1 according to the present embodiment includes the head 2 described above, the wiper 51 that slides over the head 2, and the drive unit 53 that drives the wiper 51. In the example illustrated in FIG. 8B, the drive unit 53 moves the wiper 51 in a direction that intersects the pair of long edges 5*d*. The plurality of concave portions 39 include one or more concave portions 39 in each of the pair of long edges 5*d*.

In this case, for example, because the movement direction of the wiper 51 coincides with the opening direction of the concave portions 39 of the long edge 5*d* in a plan view of the ejection surface 5*a*, a liquid can be easily drained from the concave portions 39 of the long edge 5*d*.

The same applies to the example illustrated in FIG. 8A. That is, the drive unit 53 moves the wiper 51 in a direction that intersects the pair of short edges 5*e*. The plurality of concave portions 39 include one or more concave portions 39 in each of the pair of short edges 5*e*. Accordingly, a liquid can be easily drained from the one of the short edges 5*e*.

Second Embodiment

In the description of a second embodiment, only the differences from the first embodiment will be described. Matters that are not particularly mentioned may be regarded as similar to those of the first embodiment or may be understood by analogy with the first embodiment. In the description of the second embodiment, a plate 21C that overlaps the cover plate 21B on a side opposite to the nozzle plate 21A may be referred to as a "channel plate 21C".

Figure 9A:
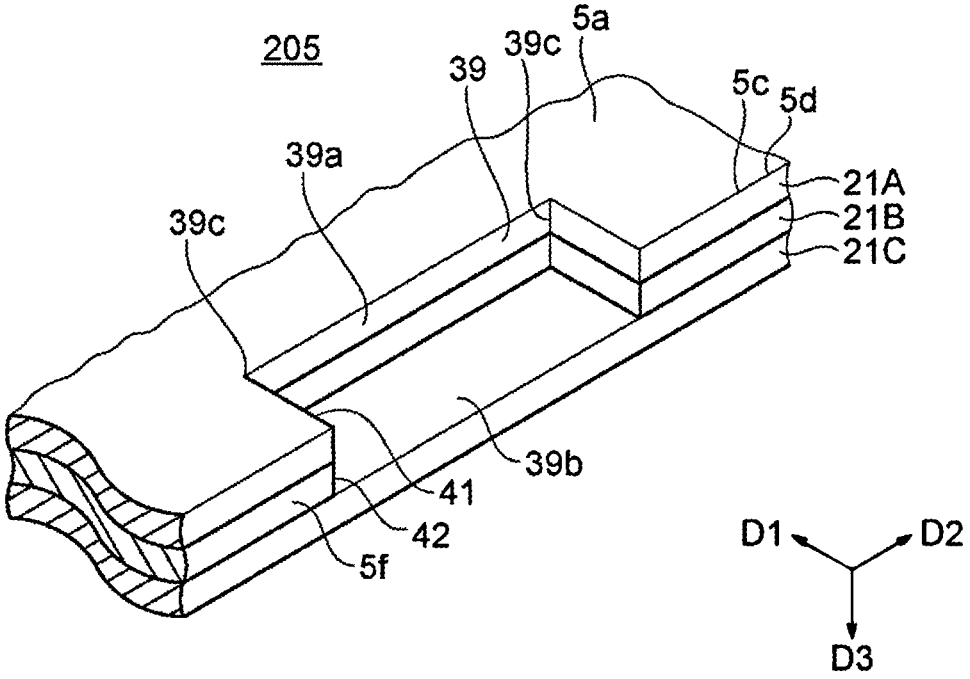
FIGS. 9A and 9B are partial enlarged perspective views of channel members respectively according to a second embodiment and a modification of the second embodiment.

FIG. 9A is a partial enlarged perspective view of a channel member 205 according to the second embodiment, corresponding to FIG. 5 of the first embodiment.

In the first embodiment, the concave portion 39 is formed because the cover plate 21B overlaps the cutout 41 (which may be referred to as a "first cutout 41" in the following description) of the nozzle plate 21A. In contrast, in the second embodiment, a cutout (second cutout 42) is formed also in the cover plate 21B, in addition to the nozzle plate 21A. The concave portion 39 is formed because the first cutout 41, the second cutout 42, and the channel plate 21C sequentially overlap.

From a different viewpoint, the concave portion 39 is constituted not by a cutout in one plate 21 but by cutouts in two or more plates 21. Although not illustrated, the concave portion 39 may be constituted by cutouts in three or more plates 21. However, in the following description, a case where the concave portion 39 is constituted by cutouts in two plates 21 will be described as an example.

In the second embodiment, all of the plurality of concave portions 39 may include the first cutout 41 and the second cutout 42 (from a different viewpoint, two or more cutouts), or only some of the plurality of concave portions 39 may include the first cutout 41 and the second cutout 42 (that is, the other concave portions 39 may be configured to include only the first cutout 41). In the latter case, the ratio of the number of concave portions 39 that include the second cutout 42 to the total number of concave portions 39, the relationship between the positions of all of the concave portions 39 and the positions of the concave portions 39 that include the second cutout 42, and the like may be set in any appropriate manner.

In the example illustrated in FIG. 9A, in a plan view, the shapes and the dimensions of the first cutout 41 and the second cutout 42 are the same as each other. Regarding the shape of the concave portion 39, which is constituted by the first cutout 41 and the second cutout 42, descriptions of the shape of the concave portion 39 in the first embodiment (and a modification of the first embodiment) may be applied. In FIG. 9A, as the planar shape of the concave portion 39, a shape having corners (to be specific, a rectangle) is shown in the same way as in FIG. 5. Needless to say, the planar shape of the concave portion 39 may be triangular as with the modification illustrated in FIGS. 7A and 7B, or may be a shape such that the inner surface thereof is constituted by a curve.

In the present embodiment, the first surface 39*a*, which is a part of the inner surfaces of the concave portion 39 that intersects the ejection surface 5*a*, is constituted by an inner surface of the first cutout 41 and an inner surface of the second cutout 42. The second surface 39*b*, which is a part of the inner surface of the concave portion 39 that serves as a bottom surface in the depth direction from the ejection surface 5*a*, is constituted by a region that is included in a surface of the channel plate 21C on the cover plate 21B side and that is exposed from the first cutout 41 and the second cutout 42. A region of the outer peripheral surface 5*f*, the region being on the ejection surface 5*a* side and between the plurality of concave portions 39, is constituted by outer peripheral surfaces of the nozzle plate 21A and the cover plate 21B.

In the first embodiment, the surface roughness of the first surface 39*a* of the concave portion 39 (in the first embodiment, the inner surface of the first cutout 41) may be greater than the surface roughness of a region of the outer peripheral surface 5*f*, the region being on the ejection surface 5*a* side and between the plurality of concave portions 39 (in the first embodiment, a region constituted by the nozzle plate 21A). In the present embodiment, the roughness relationship may hold true for both of the inner surface of the first cutout 41 and the inner surface of the second cutout 42 or may hold true for only one of the inner surfaces. In other words, the roughness relationship may hold true for the entirety of the first surface 39*a* or may hold true for only a part of the first surface 39*a* (to be more specific, a part in the depth direction from the ejection surface 5*a*). When the roughness relationship holds true for at least a part of the first surface 39*a*, at least some of the advantageous effects described in the first embodiment can be obtained. The same applies to a case where three or more cutouts overlap.

In the first embodiment, it has been described that the plurality of grooves 47, which extend from the ejection surface 5*a* side toward the back side of the ejection surface 5*a*, may be formed in the first surface 39*a* of the concave portion 39. In the present embodiment, the grooves 47 may be formed in both of or only one of the inner surface of the first cutout 41 and the inner surface of the second cutout 42. In other words, the grooves 47 may be formed in the entirety of the first surface 39*a* or may be formed in only a part of the first surface 39*a* (to be more specific, a part in the depth direction from the ejection surface 5*a*). In the former case, for example, the grooves 47 in the inner surface of the first cutout 41 and the grooves 47 in the inner surface of the second cutout 42 may be formed independent from each other before stacking the nozzle plate 21A and the cover plate 21B, and the positions and the like thereof are displaced from each other in a plan view. When the grooves 47 are formed in at least a part of the first surface 39*a*, at least some of the advantageous effects described in the first embodiment regarding the grooves 47 can be obtained. The same applies also to a case where three or more cutouts overlap.

In the first embodiment, the second surface 39*b* may be constituted by the cover plate 21B itself or may be constituted by the adhesive 43 applied to the nozzle plate 21A side of the cover plate 21B. Likewise, in the present embodiment, the second surface 39*b* may be constituted by the cover plate 21C itself or may be constituted by the adhesive 43 applied to the cover plate 21B side of the channel plate 21C. Likewise, in a case where three or more cutouts, the second surface 39*b* may be constituted by surfaces of the plates 21 themselves or may be constituted by the adhesive 43. The advantageous effects obtained in the case where the second surface 39*b* is constituted by the adhesive 43 are, for example, the same as those of the first embodiment.

Also in the second embodiment, the channel member 205 includes the plurality of concave portions 39 in the outer edge 5*c* of the ejection surface 5*a*, the plurality of concave portions 39 being recessed in the ejection surface 5*a* and being recessed in the outer peripheral surface 5*f*. Accordingly, advantageous effects that are the same as those of the first embodiment can be obtained. For example, a liquid (such as ink mist) that has leaked out from the ejection hole 9 can be collected in the concave portion 39.

In the present embodiment, the channel member 205 includes the nozzle plate 21A including the plurality of ejection holes 9, the cover plate 21B overlapping a side of the nozzle plate 21A opposite to the ejection surface 5*a*, and the channel plate 21C overlapping a side of the cover plate 21B opposite to the nozzle plate 21A. The nozzle plate 21A includes the plurality of first cutouts 41 in an outer edge thereof in a plan view. The cover plate 21B includes at least one second cutout 42 in an outer edge thereof in a plan view. At least one of the plurality of concave portions 39 is formed because at least one of the plurality of first cutouts 41, the at least one second cutout 42, and the channel plate 21C sequentially overlap.

In this case, for example, compared with the first embodiment, it is easy to increase the depth of the concave portions 39 from the ejection surface 5*a*. As a result, for example, while reducing the number of the concave portions 39 and/or the area of the concave portions 39 in the ejection surface 5*a*, the collection amount of liquid can be increased. By reducing the number and/or the area of the concave portions 39, for example, it is possible to provide a sufficient bonding area for bonding the nozzle plate 21A and the cover plate 21B and to reduce the probability that the nozzle plate 21A is peeled off.

(Modification)

Figure 9B:
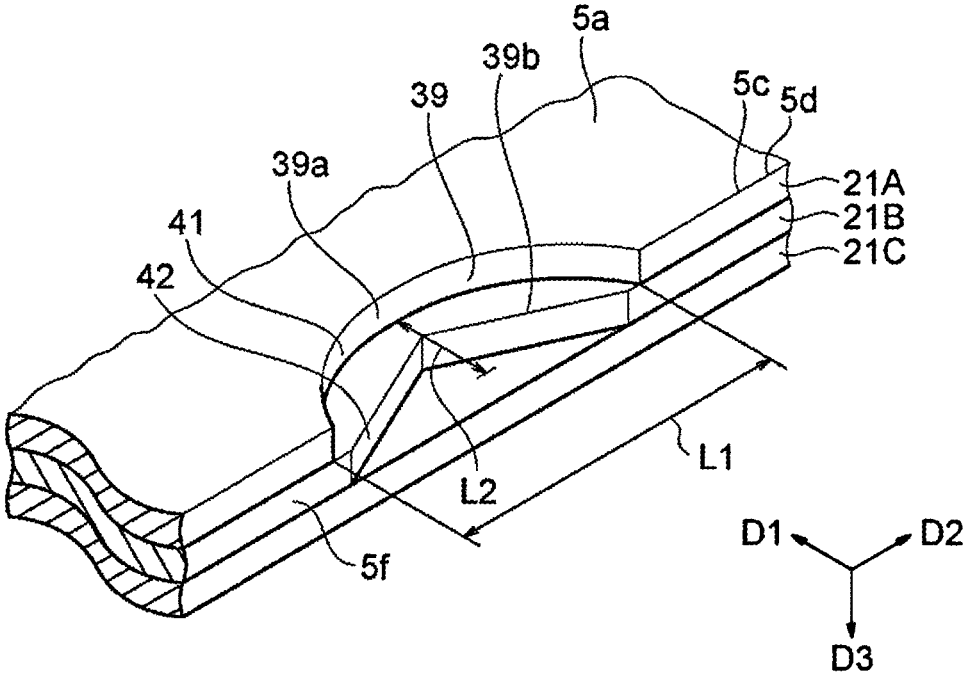

FIG. 9B is a perspective view illustrating a modification of the channel member 205 of the second embodiment.

As illustrated in this figure, the shapes and/or the dimensions of the first cutout 41 and the second cutout 42 may differ from each other. In this case, the first cutout 41 and the second cutout 42 may each have various shapes and dimensions.

In the illustrated example, the shape of the first cutout 41 and the shape of the second cutout 42 differ from each other. To be more specific, the first cutout 41 includes an inner surface that is constituted by a curve in a plan view, as with the first cutout 41 illustrated in FIG. 7B. On the other hand, the second cutout 42 includes an inner surface including a concave corner in a plan view, as with the first cutout 41 illustrated in FIG. 7A. Although not illustrated, both of the first cutout 41 and the second cutout 42 may have an inner surface including a corner or may have an inner surface constituted by a curve. The vertical relationship between an inner surface including a corner and an inner surface including a curve may be the opposite to this. The shape having a corner may be a triangular shape as in the example illustrated in FIG. 9B, or may be a rectangular shape as in the example illustrated in FIG. 9A.

From a different viewpoint, as shown in the modification, in the case where the concave portion 39 includes an inner surface including a concave corner in a plan view, the inner surface need not be the entirety of the first surface 39*a* and may be a part in the depth direction from the ejection surface 5*a*. Likewise, in a case where the concave portion 39 includes an inner surface constituted by a curve in a plan view, the inner surface need not be the entirety of the first surface 39*a* and may be a part in the depth direction from the ejection surface 5*a*. Even in such cases, at least some of the advantageous effects that have been described as examples in the first embodiment regarding a corner or a curve having a concave shape in a plan view can be obtained.

In the illustrated example, the length of the first cutout 41 in the D2 direction (direction along the outer edge 5*c*) differs from the length of the second cutout 42 in the D2 direction. To be more specific, the former is greater than the latter. In the illustrated example, the depth of the first cutout 41 from the outer edge 5*c* (the maximum length in the D1 direction)

and the depth of the second cutout 42 from the outer edge 5*c* differ from each other. To be more specific, the former is greater than the latter. From a different viewpoint, in the illustrated example, in a plan view, the entirety of the second cutout 42 overlaps only a part of the first cutout 41. In such a case, the difference between the area of the first cutout 41 and the area of the second cutout 42 may be set in any appropriate manner. For example, the difference between these may be greater than or equal to 5%, 10%, or 50% of the area of the first cutout 41.

Although not illustrated, the first cutout 41 and the second cutout 42 have shapes that are similar or substantially similar to each other, and the entirety of the second cutout 42 may overlap only a part of the first cutout 41. In contrast to the illustrated example, in a plan view, the entirety of the first cutout 41 may overlap only a part of the second cutout 42, or only a part of the first cutout 41 may overlap only a part of the second cutout 42.

The configuration such that the shapes and the dimensions of the first cutout 41 and the second cutout 42 are the same as each other as illustrated in FIG. 9A, and the configuration such that, as in the present modification, the entirety of the second cutout 42 overlaps only a part of the first cutout 41 can be each regarded as a configuration such that the first cutout 41 is contained within the second cutout 42 in a plan view.

In the first embodiment, regarding the length L1 of the concave portion 39 in the D2 direction and the depth L2 from the outer edge 5*c*, the specific magnitudes and the like thereof have been described. Moreover, it has been described that the length L1 and the depth L2 may be the maximum length and the maximum depth, in a case where the shape of the concave portion 39 is not rectangular. As in the present embodiment, in a case where the planer shape and/or the dimensions thereof differ depending on the position in the depth direction from the ejection surface 5*a*, for example, the maximum length and the maximum depth in the entirety in the depth direction may regarded as the length L1 and the depth L2, and the description in the first embodiment may be applied. In FIG. 9B, because the first cutout 41 is greater than the second cutout 42 regarding dimensions in any direction in a plan view, dimension lines representing the length L1 and the depth L2 are attached to the first cutout 41.

As described above, in the present modification, in a plan view of the ejection surface 5*a*, the entirety of each of the at least one second cutout 42 included in at least one of the plurality of concave portions 39 is contained within the first cutout 41 that overlaps the second cutout 42.

In this case, for example, because the area the nozzle plate 21A can provide a sufficient bonding area for bonding the nozzle plate 21A and the cover plate 21B, the effect of reducing the probability of the aforementioned peeling-off can be improved. For example, a liquid can easily enter the concave portion 39 from the ejection surface 5*a* side, while the liquid can be easily drained from the concave portion 39 when wiping is performed.

In the embodiments described above, the head 2 or the head body 2*a* is an example of a liquid ejection head. The printer 1 is an example of a recording device. Ink is an example of a liquid. The print paper P is an example of a recording medium.

The technology according to the present disclosure is not limited to the embodiments described above and may be carried out in various configurations.

The liquid ejection head is not limited to a piezoelectric head that applies a pressure to a liquid by using a piezoelectric element, and may be, for example, a thermal head that generates bubbles in a liquid by heat to apply a pressure to the liquid. As mentioned in the description of the embodiments, the concave portion positioned in an outer edge of the ejection surface may be provided only in a long edge, only in a short edge, at a corner formed by the long edge and the short edge; and the shape and the dimensions of the concave portion may be any appropriate shape and dimensions.

In the example described in the present embodiment, the surface roughness of the first surface of the plurality of concave portions is greater than the surface roughness of a region of the outer peripheral surface, the region being on the ejection surface side and between the plurality of concave portions. However, the surface roughness of the former need not be greater than that of the latter. To be specific, the surface roughness of a region of the outer peripheral surface, the region being on the ejection surface side and between the plurality of concave portions, may be greater than the surface roughness of the first surface of the plurality of concave portions. In this case, ink mist adhered to the outer peripheral surface can be easily retained on the outer peripheral surface due to a capillary action.

The invention claimed is:

1. A liquid ejection head, comprising:

a channel member including an ejection surface, an outer peripheral surface that is connected to an outer edge of the ejection surface and that faces outside of the ejection surface in a direction along the ejection surface, a plurality of ejection holes that open in the ejection surface, and a plurality of concave portions in the outer edge of the ejection surface, the plurality of concave portions being recessed in the ejection surface and in the outer peripheral surface, wherein a surface roughness of at least a part of an inner surface of each of the plurality of concave portions, the inner surface intersecting the ejection surface, is greater than a surface roughness of a region of the outer peripheral surface, the region being on the ejection surface side and between the plurality of concave portions.

2. The liquid ejection head according to claim 1, wherein each of the plurality of concave portions includes the inner surface in at least a part thereof in a depth direction from the ejection surface, the inner surface including a concave corner in a plan view of the ejection surface.

3. The liquid ejection head according to claim 1, wherein each of the plurality of concave portions includes the inner surface in at least a part thereof in a depth direction from the ejection surface, the inner surface being constituted by a concave curve in a plan view of the ejection surface.

4. The liquid ejection head according to claim 1, wherein, in a plan view of the ejection surface, a length of each of the plurality of concave portions in a direction along the outer edge of the ejection surface is greater than a depth of the concave portion from the outer edge of the ejection surface.

5. The liquid ejection head according to claim 1, wherein each of the plurality of concave portions includes a plurality of grooves in the inner surface thereof, the plurality of grooves extending from the ejection surface side toward a back side of the ejection surface.

6. The liquid ejection head according to claim 1,
wherein the channel member further includes
a nozzle plate including the plurality of ejection holes, and
a cover plate overlapping a side of the nozzle plate opposite to the ejection surface, the nozzle plate includes a plurality of first cutouts in an outer edge of the nozzle plate in a plan view of the ejection surface, and
at least one of the plurality of concave portions is defined by the cover plate overlapping at least one of the plurality of first cutouts.

7. The liquid ejection head according to claim 6,
wherein the channel member includes an adhesive that is interposed between and bonded to the nozzle plate and the cover plate, and
the adhesive covers a region of the cover plate, the region being exposed from the at least one of the plurality of first cutouts.

8. The liquid ejection head according to claim 5,
wherein the channel member further includes
a nozzle plate including the plurality of ejection holes,
a cover plate overlapping a side of the nozzle plate opposite to the ejection surface,
an adhesive interposed between and bonded to the nozzle plate and the cover plate, and
a water-repellent film that covers the ejection surface side of the nozzle plate and that has a higher water-repellency than the adhesive.

9. The liquid ejection head according to claim 5,
wherein the outer edge of the ejection surface includes
a pair of long edges that face each other and
a pair of short edges that connect end portions of the pair of long edges to each other, and
wherein, when a first region that has a minimum width within which all of the plurality of ejection holes are contained and that extends along the pair of long edges is assumed in the ejection surface, the plurality of concave portions include, in each of the pair of short edges and on each of two sides in a width direction of the first region, a concave portion whose centroid is positioned outside of a width of the first region, and do not include a concave portion whose centroid is positioned inside of the width of the first region.

10. A recording device comprising:
the liquid ejection head according to claim 5;
a wiper that slides over the liquid ejection head; and
a drive unit that drives the wiper,
wherein the outer edge of the ejection surface includes
a pair of long edges that face each other and
a pair of short edges that connect end portions of the pair of long edges to each other,
wherein the drive unit moves the wiper in a direction that intersects the pair of long edges, and
wherein the plurality of concave portions includes one or more concave portions in each of the pair of long edges.

11. A recording device comprising:
the liquid ejection head according to claim 5;
a wiper that slides over the liquid ejection head; and
a drive unit that drives the wiper,
wherein the outer edge of the ejection surface includes a pair of long edges that face each other and a pair of short edges that connect end portions of the pair of long edges to each other,
wherein the drive unit moves the wiper in a direction that intersects the pair of short edges, and
wherein the plurality of concave portions includes one or more concave portions in each of the pair of short edges.

12. A liquid ejection head, comprising:
a channel member including
an ejection surface,
an outer peripheral surface that is connected to an outer edge of the ejection surface and that faces outside of the ejection surface in a direction along the ejection surface,
a plurality of ejection holes that open in the ejection surface,
a plurality of concave portions in the outer edge of the ejection surface, the plurality of concave portions being recessed in the ejection surface and in the outer peripheral surface,
a nozzle plate including the plurality of ejection holes, the nozzle plate including a plurality of first cutouts in an outer edge thereof in a plan view;
a cover plate overlapping a side of the nozzle plate opposite to the ejection surface, the cover plate including at least one second cutout in an outer edge thereof in a plan view; and
a channel plate overlapping a side of the cover plate opposite to the nozzle plate,
wherein at least one of the plurality of concave portions is formed because at least one of the plurality of first cutouts, the at least one second cutout, and the channel plate sequentially overlap.

13. The liquid ejection head according to claim 12,
wherein, in a plan view of the ejection surface, an entirety of each of the at least one second cutout is contained within the at least one of the plurality of first cutouts that overlaps the second cutout.

14. A nozzle plate, comprising:
a plurality of ejection holes; and
a cutout in a first long edge of the nozzle plate, wherein
in a plan view of the nozzle plate, the plurality of ejection holes includes at least one ejection hole located at a region between the cutout and a second long edge of the nozzle plate, the second long edge being opposite to the first long edge.

15. The nozzle plate according to claim 14, wherein
a length of the cutout in a direction along the first long edge is longer than a diameter of each of the plurality of ejection holes.

16. The nozzle plate according to claim 14, further comprising:
another cutout in the second long edge, wherein
in the plan view, the plurality of ejection holes includes at least one ejection hole located at a region between the another cutout and the first long edge.

17. The nozzle plate according to claim 14, wherein
an inner surface of the cutout includes a concave corner in the plan view.

18. The nozzle plate according to claim 14, wherein
an inner surface of the cutout is constituted by a concave curve in the plan view.

19. A liquid ejection head, comprising:
the plate according to claim 14, comprising an ejection surface with the plurality of ejection holes being open; and
a cover plate overlapping a side of the nozzle plate opposite to the ejection surface, the cover plate comprising a cover-plate cutout that overlaps the cutout.

20. The liquid ejection head according to claim 19, wherein
the cover-plate cutout has a shape same as that of the cutout.

* * * * *